US007393069B2

(12) United States Patent
Kusunoki

(10) Patent No.: US 7,393,069 B2
(45) Date of Patent: Jul. 1, 2008

(54) IMAGE FORMING APPARATUS

(75) Inventor: Naoki Kusunoki, Kanagawa (JP)

(73) Assignee: Fujifilm Corporation, Tokyo (JP)

( * ) Notice: Subject to any disclaimer, the term of this patent is extended or adjusted under 35 U.S.C. 154(b) by 276 days.

(21) Appl. No.: 11/237,671

(22) Filed: Sep. 29, 2005

(65) Prior Publication Data

US 2006/0109295 A1 May 25, 2006

(30) Foreign Application Priority Data

Sep. 30, 2004 (JP) ..... 2004-288788
Sep. 30, 2004 (JP) ..... 2004-288789

(51) Int. Cl.
*B41J 29/38* (2006.01)
*B41J 2/15* (2006.01)
*B41J 2/205* (2006.01)

(52) U.S. Cl. ..... 347/5; 347/41; 347/15

(58) Field of Classification Search ..... 347/5, 347/102, 15, 41
See application file for complete search history.

(56) References Cited

U.S. PATENT DOCUMENTS 6,059,407 A * 5/2000 Komatsu et al. ..... 347/103
6,406,114 B1 * 6/2002 Shioya ..... 347/15

FOREIGN PATENT DOCUMENTS

JP 11-42799 A 2/1999
JP 2001-18374 A 1/2001
JP 2001-129982 A 5/2001
JP 2001-158093 A 6/2001
JP 2002-120361 A 4/2002

* cited by examiner

*Primary Examiner*—Julian D. Huffman
*Assistant Examiner*—Jason S Uhlenhake
(74) *Attorney, Agent, or Firm*—Birch, Stewart, Kolasch & Birch, LLP

(57) ABSTRACT

The image forming apparatus comprises: a liquid droplets ejection head which has a plurality of nozzles in a main scanning direction, the liquid droplets ejection head ejecting droplets of liquid toward a predetermined recording medium from one of the nozzles selected from the plurality of nozzles according to a predetermined image signal so that an image comprising a plurality of dots corresponding to the image signal is formed on the recording medium; a relative movement device which moves the liquid droplets ejection head and the recording medium relative to each other in a sub-scanning direction by causing the liquid droplets ejection head to scan the recording medium several times in order to eject the droplets of the liquid so that the adjacent dots in the sub-scanning direction are formed by overlapping with each other; a fixing time specifying device which specifies a fixing time during which each of the dots is fixed on the recording medium; a deposition order setting device which sets a deposition order of the dots in the sub-scanning direction according to an overlap degree of the adjacent dots in at least the sub-scanning direction; and a deposition time difference setting device which sets a difference between deposition times of the adjacent dots in the sub-scanning direction so that the difference between the deposition times of the adjacent dots in the sub-scanning direction is more than the fixing time of each of the dots.

17 Claims, 23 Drawing Sheets

Vn=2

Vn=3

IMAGE FORMING APPARATUS

BACKGROUND OF THE INVENTION

1. Field of the Invention

The present invention relates to an image forming apparatus, and more particularly to an image forming apparatus that can prevent interference between deposited dots when forming an image which comprises a plurality of dots.

2. Description of the Related Art

Conventionally, as an image forming apparatus, an inkjet printer (inkjet recording apparatus) is known which comprises an inkjet head (liquid ejection head) having an arrangement of a plurality of nozzles and which records images on a recording medium by ejecting ink from the nozzles toward the recording medium while causing the inkjet head and the recording medium to move relatively to each other.

In such an inkjet printer, there is a problem of so called "interference of deposited dots", that is, a dot shape created by dots on a recording medium is deformed when the dots formed by ejecting adjacent liquid droplets overlapping to each other from the nozzles onto the recording medium.

In order to prevent such interference of deposited dots, an inkjet printer is proposed in which, of the plurality of numbers of ejections, a pre-established output waiting time (specifically, a waiting time for n times drum rotations) is inputted before depositing dots in the main scanning direction or sub-scanning direction so that the adjacent dots overlap to each other (see Japanese Patent Application Publication No. 2001-129982)

An inkjet printer is also proposed in which, when ejecting ink with different colors (for example, yellow and magenta) onto on section on the recording medium, the ejection is performed by the number of rotations of the drum (see Japanese Patent Application Publication No. 11-042799). In the case of using two colors, this object is achieved such that the time spent until dots in the both inks overlap can be increased by at least one rotation of the drum.

A configuration of inkjet printer is also proposed so that a time T until different color dots make contact with each other or a time T until overlap at deposited positions (namely, color overlapping time) is represented by $T \geqq 10$ msec (see Japanese Patent Application Publication No. 2002-120361).

However, in the prior art, there is a problem that an image cannot be formed at high speed even if the interference of deposited dots is resolved.

Furthermore, in Japanese Patent Application Publication Nos. 2001-129982, 11-042799, and 2002-120361, there is no concrete description relating to technologies for preventing interference of deposited dots which are adjacent to each other in a state of overlapping to each other in the sub-scanning direction.

Moreover, in Japanese Patent Application Publication Nos. 2001-129982, 11-042799, and 2002-120361, there is no concrete description relating to technologies for preventing interference of deposited dots which are adjacent to each other in a state of overlapping to each other in the sub-scanning and main scanning directions.

SUMMARY OF THE INVENTION

The present invention has been contrived in view of the aforementioned circumstances, and an object thereof is to provide an image forming apparatus that can prevent interference of deposited adjacent overlapping to each other, and then an image can be formed at high speed.

In order to attain the aforementioned object, the present invention is directed to an image forming apparatus comprising: a liquid droplets ejection head which has a plurality of nozzles in a main scanning direction, the liquid droplets ejection head ejecting droplets of liquid toward a predetermined recording medium from one of the nozzles selected from the plurality of nozzles according to a predetermined image signal so that an image comprising a plurality of dots corresponding to the image signal is formed on the recording medium; a relative movement device which moves the liquid droplets ejection head and the recording medium relative to each other in a sub-scanning direction by causing the liquid droplets ejection head to scan the recording medium several times in order to eject the droplets of the liquid so that the adjacent dots in the sub-scanning direction are formed by overlapping with each other; a fixing time specifying device which specifies a fixing time during which each of the dots is fixed on the recording medium; a deposition order setting device which sets a deposition order of the dots in the sub-scanning direction according to an overlap degree of the adjacent dots in at least the sub-scanning direction; and a deposition time difference setting device which sets a difference between deposition times of the adjacent dots in the sub-scanning direction so that the difference between the deposition times of the adjacent dots in the sub-scanning direction is more than the fixing time of each of the dots.

According to the present invention, since a fixing time for every dot on the recording medium is specified, a deposition order of dots in the sub-scanning direction is set according to the overlap degree of the adjacent dots in at least the sub-scanning direction. Therefore, since the deposition time difference between the adjacent dots in the sub-scanning direction can be set to be at least the fixing time for every dot, then it is possible to prevent interference of deposited adjacent dots overlapping to each other, thereby forming an image at high speed.

The present invention is also directed to the image forming apparatus wherein the deposition order setting device sets the deposition order of the dots in the sub-scanning direction according to the fixing time of each of the dots, an output resolution in the sub-scanning direction, and the overlap degree of the adjacent dots in the sub-scanning direction.

According to the present invention, a deposition order of dots in the sub-scanning direction is set according to a fixing time for each of the dots and an output resolution. Therefore, interference of deposited dots can be prevented more appropriately, and a high-quality image can be formed at high speed.

The present invention is also directed to the image forming apparatus wherein: M is an integer more than the overlap degree of the adjacent dots in the sub-scanning direction, and then N is a natural number; the deposition order setting device divides a row of the dots in the sub-scanning direction into N groups with the M as a basic unit; and the deposition order setting device sets the deposition order of the dots in the sub-scanning direction so that the dots are deposited with (M−1) dots interval.

According to the present invention, the integer M indicating the overlap degree of the adjacent dots in at least the sub-scanning direction is taken as a basic unit so as to divide a row of dots into groups, and dots is deposited with (M−1) interval. Therefore, since a difference between the deposition times of the adjacent dots becomes substantially uniform, irregularity in the fixed dots can be eliminated.

The present invention is also directed to the image forming apparatus wherein: the relative movement device further comprises a rotating body which has a circumferential length;

and the circumferential length corresponds to the fixing time of each of the dots, an output resolution in the sub-scanning direction, ejection cycles of the nozzles, and the basic unit M.

According to the present invention, an image can be formed at high speed by means of the rotating body with the appropriate circumferential length.

The present invention is also directed to the image forming apparatus wherein: the relative movement device further comprises a rotating body which has a circumferential length; and the circumferential length corresponds to the fixing time of each of the dots according to a combination of a most used type of the recording medium and a most used type of the liquid, a maximum value of an output resolution in the sub-scanning direction, a shortest ejection cycle of the nozzles, and an overlap degree of the dots when forming the image at a high quality mode.

According to the present invention, in the case of combining a recording medium and an ink which are used in highest frequency, the maximum image formation speed can be realized even if an image is formed in a high image quality mode.

The present invention is also directed to the image forming apparatus wherein the basic unit M in the groups is equal to the overlap degree of the dots.

According to the present invention, since the N as the basic unit can be set larger, an image can be formed at high speed.

The present invention is also directed to the image forming apparatus wherein: when the dots with different dot diameters are deposited, the deposition order setting device sets the deposition order by means of the overlap degree of the dots with the largest dot diameter.

According to the present invention, while the computation load in the control system can be reduced, interference of deposited dots can be eliminated completely, and hence a high-quality image can be stably formed.

The present invention is also directed to the image forming apparatus wherein the relative movement device is constituted by a rotating drum which rotates while wrapping the recording medium around the surface of the rotating drum.

According to the present invention, it is possible to obtain a structure in which a plurality of travel motions of the recording medium are simplified.

The present invention is also directed to the image forming apparatus wherein: the relative movement device comprises a rotating transfer drum which functions as an intermediate transfer recording medium, and a transfer device which applies pressure to the rotating transfer drum and the recording medium in order to perform transfer.

According to the present invention, it is possible to form a high-quality image at high speed, without influencing the penetration characteristics of the recording medium.

In order to attain the aforementioned object, the present invention is directed to an image forming apparatus comprising: a liquid droplets ejection head which has a plurality of nozzles in a main scanning direction, the liquid droplets ejection head ejecting droplets of liquid toward a predetermined recording medium from one of the nozzles selected from the plurality of nozzles according to a predetermined image signal so that an image comprising a plurality of dots corresponding to the image signal is formed on the recording medium; a relative movement device which moves the liquid droplets ejection head and the recording medium relative to each other in a sub-scanning direction by causing the liquid droplets ejection head to scan the recording medium several times; a fixing time specifying device which specifies a fixing time during which each of the dots is fixed on the recording medium; a deposition order setting device which sets a deposition order of the dots in the sub-scanning direction and the main scanning direction according to the overlap degree of the dots in an oblique direction with respect to at least the sub-scanning direction; and a deposition time difference setting device which sets a difference between deposition times of the adjacent dots so that the difference between the deposition times of the adjacent dots overlapping with each other is more than the fixing time of each of the dots.

According to the present invention, since a fixing time for each of dots on the recording medium is specified, it is possible to set a deposition order of dots in the main scanning direction and sub-scanning direction according to the overlap degree of dots in at least the oblique direction. Therefore, since a difference between deposition times of the adjacent dots overlapped to each other is set to be equal to or more than the fixing time for each of the dots, it is possible to prevent interference of all deposited dots overlapping to each other in a deposited arrangement in which the dots are overlapped in two-dimensionally, and to form the image at high speed.

The present invention is also directed to the image forming apparatus wherein: the overlap degree of the dots in the oblique direction is $V\alpha$, and then the overlap degree of the dots in the main scanning direction is Vm; the deposition order setting device divides a row of the dots in the sub-scanning direction with $V\alpha \times Vm$ as a basic unit so that the droplets are deposited with $(V\alpha \times Vm-1)$ dots interval in the sub-scanning direction; and the deposition order setting device sets the deposition order by setting a phase difference of the $V\alpha$ dots between the adjacent dots in the main scanning direction so that the droplets are deposited with $(Vm-1)$ dots interval in the main scanning direction.

According to the present invention, since an image is formed in the minimum number of main scanning in the deposited arrangement in which the dots are overlapped two-dimensionally, the image can be formed at the highest speed.

The present invention is also directed to the image forming apparatus wherein: the deposition order is set according to the fixing time of each of the dots, the overlap degree of the dots in the main scanning direction, and the overlap degree of the dots in the oblique direction.

According to the present invention, since a deposition order of dots in the sub-scanning direction is set according to a fixing time for each of dots and an overlap degree of dots in a main scanning direction and an oblique direction, it is possible to prevent interference of deposited dots more appropriately, thereby forming a high-quality image at high speed.

The present invention is also directed to the image forming apparatus wherein the deposition time difference setting device sets an ejection cycle of each of the nozzles according to the deposition order which is set by the deposition order setting device.

According to the present invention, since an appropriate ejection cycle is set according to the deposition order, it is possible to form an image at high speed.

The present invention is also directed to The image forming apparatus wherein: when the dots with different dot diameters are deposited, the deposition order setting device sets the deposition order by means of the overlap degree of the dots with a largest dot diameter.

According to the present invention, severest condition for preventing interference of deposited dots is to control an overlap degree of the dots having largest dot diameters. Therefore, by controlling the depositing under the severest condition, the interference of entire deposited dots can be resolved completely.

In order to attain the aforementioned object, the present invention is directed to an image forming apparatus comprising: a liquid droplets ejection head which has a plurality of nozzles in a main scanning direction, the liquid droplets ejection head ejecting droplets of liquid toward a predetermined recording medium from one of the nozzles selected from the plurality of nozzles according to a predetermined image signal so that an image comprising a plurality of dots corresponding to the image signal is formed on the recording medium; a relative movement device which moves the liquid droplets ejection head and the recording medium relative to each other in a sub-scanning direction by causing the liquid droplets ejection head to scan the recording medium several times; a fixing time specifying device which specifies a fixing time during which each of the dots is fixed on the recording medium; a deposition order setting device which sets a deposition order so that the droplets are deposited with (M−1) dots interval in the sub-scanning direction, the deposition order setting device setting the deposition order so that the droplets are deposited sequentially from (i×Vm+1)-th main scanning line to ((i+1)×Vm)-th main scanning line, the M being an integer for satisfying a condition of M≧Vs, the Vs is the overlap degree of the dots in the sub-scanning direction, the Vm being the overlap degree of dots in the main scanning direction, the i being an integer more than 0; and a deposition time difference setting device which sets a difference between deposition times of the adjacent dots so that the difference between the deposition times of the adjacent dots overlapping with each other is more than the fixing time of each of the dots.

According to the present invention, in a deposited arrangement in which the dots are overlapped two-dimensionally, it is possible to prevent interference of entire deposited dots overlapping to each other, thereby forming an image at high speed. In addition, since the difference between the deposited times of the adjacent dots becomes substantially uniform, it is possible to eliminate irregularity in the fixed dots.

The present invention is also directed to the image forming apparatus wherein the relative movement device is constituted by a rotating drum which rotates while wrapping the recording medium around the surface of the rotating drum.

According to the present invention, it is possible to obtain a structure in which a plurality of travel motions of the recording medium can be simplified.

The present invention is also directed to the image forming apparatus wherein: the relative movement device comprises a rotating transfer drum which functions as an intermediate transfer recording medium, and a transfer device which applies pressure to the rotating transfer drum and the recording medium in order to perform transfer.

According to the present invention, it is possible to form a high-quality image at high speed, without influencing the penetration characteristics of the recording medium.

As described above, according to the present invention, it is possible to prevent interference of deposited dots which are adjacent to each other in a state of overlapping to each other, thereby forming an image at high speed.

BRIEF DESCRIPTION OF THE DRAWINGS

The nature of this invention, as well as other objects and advantages thereof, will be explained in the following with reference to the accompanying drawings, in which like reference characters designate the same or similar parts throughout the figures and wherein.

DETAILED DESCRIPTION OF THE PREFERRED EMBODIMENTS

Figure 1A:
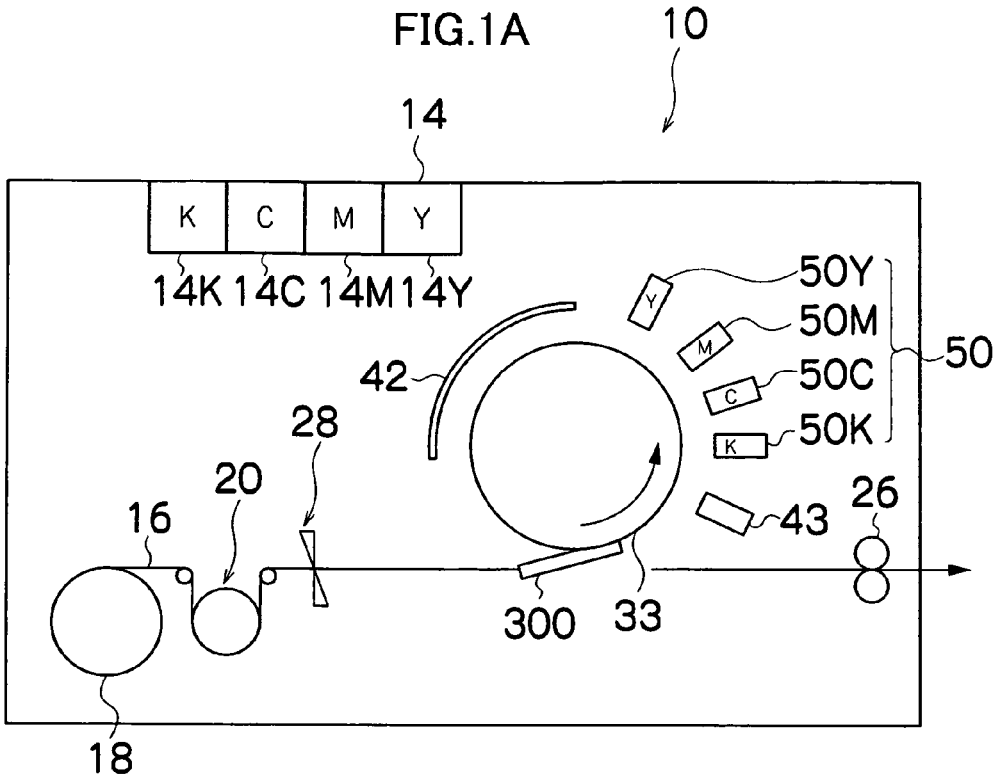
FIGS. 1A and 1B are general schematic diagrams showing examples of an inkjet recording apparatus as an image forming apparatus according to an embodiment of the present invention.

FIG. 1A is a general schematic diagram showing an example of an inkjet recording apparatus 10 as an image forming apparatus according to an embodiment of the present invention.

As shown in FIG. 1A, the inkjet recording apparatus 10 comprises: a plurality of liquid droplets ejection heads 50 (50K, 50C, 50M, and 50Y) provided for respective ink colors; an ink storing and loading unit 14 (14K, 14C, 14M, and 14Y)

which stores ink to be supplied to the liquid droplets ejection heads 50K, 50C, 50M, and 50Y; a paper supply unit 18 which supplies paper such as a recording medium 16; a decurling unit 20 which eliminates curl from the recording medium 16; a cutter 28 which cuts the recording medium 16; a paper output unit 26 which ejects the recording medium 16; a rotating drum 33 (relative movement device) which causes the liquid droplets ejection heads 50 to scan a plurality of number of times with respect to the recording medium 16, and moves the recording medium 16 relatively with respect to the liquid droplets ejection heads 50 in the sub-scanning direction so that adjacent dots in the sub-scanning direction are formed by ejection and overlap with each other; a paper wrapping and unwrapping member 300 which functions as a conveyance path for wrapping the recording medium 16 in the form of a cut sheet around the rotating drum 33 and for unwrapping the recording medium 16 from the rotating drum 33; a UV radiation light source 42 which irradiates the recording medium 16 with UV (ultraviolet) radiation; and a synchronous detecting sensor 43 which synchronizes the relative movement of the recording medium 16 and the liquid droplets ejection heads 50, ejection of liquid droplet from the liquid droplets ejection heads 50, and the like.

In FIG. 1A, a magazine for rolled paper (continuous paper) is shown as an example of the paper supply unit 18; however, more magazines with paper differences such as paper width and quality may be jointly provided. Moreover, papers may be supplied with cassettes that contain cut papers loaded in layers and that are used jointly or in lieu of the magazine for rolled paper.

In the case of the configuration in which roll paper is used, a cutter 28 is provided as shown in FIG. 1A, and the continuous paper is cut into a desired size by the cutter 28. When cut papers are used, the cutter 28 is not required.

In the case of a configuration in which a plurality of types of recording media can be used, it is preferred that ink ejection control be performed such that, by attaching information recording body such as a bar code or wireless tag in which the information on the type of recording medium is recorded to a magazine, and reading the information in the information recording body by means of a predetermined reading apparatus, the type of a recording medium to be used is identified automatically, and an appropriate ink ejection is realized according to the type of the recording medium.

Moreover, in FIG. 1A, the rotating drum 33 is shown as the relative movement device for moving the recording medium 16 relatively with respect to the liquid droplets ejection heads 50, which wraps the recording medium 16 around the circumference thereof and moves the recording medium. For the rotating drum 33, generally a vacuum suction rotating drum or an electrostatic suction rotating drum is used.

It should be noted in the present invention that the relative movement device is not particularly limited to the rotating drum 33, thus, instead of the rotating drum 33, a belt for moving the recording medium 16 relatively with respect to the liquid droplets ejection heads 50 in a specified direction (for example, a horizontal direction) may be provided. Generally, the belt has a width dimension which is greater than the width of the recording medium 16, and, in the surface of this belt, there are formed a large number of suction holes (not shown).

The liquid droplets ejection heads 50K, 50C, 50M, and 50Y is a so-called "full line head" in which a line head having a length corresponding to the maximum paper width is arranged in a direction (main scanning direction) that is perpendicular to the paper conveyance direction (the sub-scanning scanning direction).

Each of the liquid droplets ejection heads 50K, 50C, 50M, and 50Y is composed of a line head, in which a plurality of nozzles (ink ejection ports) are arranged along a length that exceeds at least one side of the maximum-size recording medium 16 intended for use in the inkjet recording apparatus 10.

The liquid droplets ejection heads 50K, 50C, 50M, and 50Y corresponding to respective colors of ink are arranged in the order of black (K), cyan (C), magenta (M), and yellow (Y) from the upstream side (left side in FIG. 1A) along the conveyance direction (sub-scanning direction) of the recording medium 16. A color image can be formed on the recording medium 16 by ejecting the inks from the liquid droplets ejection heads 50K, 50C, 50M, and 50Y, respectively, onto the recording medium 16 while conveying the recording medium 16.

The line head, in which the liquid droplets ejection heads 50K, 50C, 50M, and 50Y covering the entire width of the paper are thus provided for the respective ink colors, can record an image over the entire surface of the recording medium 16 by performing the action of moving the recording medium 16 and the liquid droplets ejection heads 50K, 50C, 50M, and 50Y relatively to each other in the sub-scanning direction several times (i.e., with several sub-scans).

Although a configuration with four standard colors KMCY is described in the present embodiment, the combinations of the ink colors and the number of colors are not limited to these, and light and/or dark inks can be added as required. For example, a configuration is possible in which print heads for ejecting light-colored inks such as light cyan and light magenta are added.

Figure 1B:
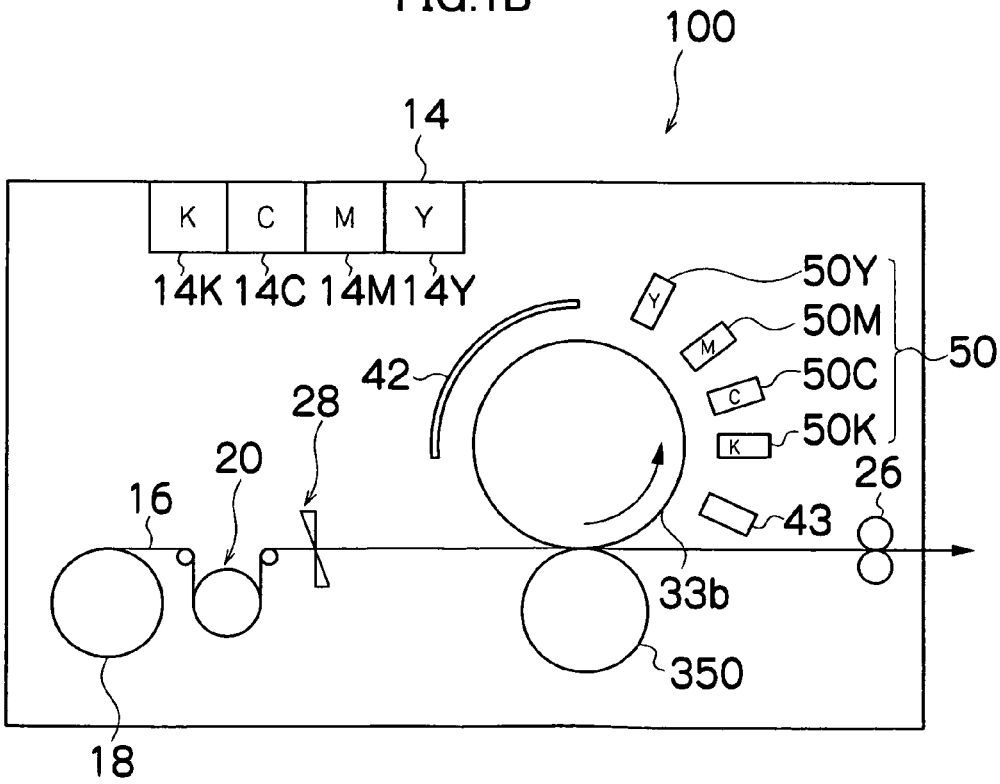

FIG. 1B is a general schematic diagram showing another example of an inkjet recording apparatus 100 as an image forming apparatus according to an embodiment of the present invention.

In FIG. 1B, items which are the same as or similar to those in FIG. 1A are labeled with the same reference numerals, and description thereof is omitted here, because they have been already described.

As shown in FIG. 1B, the inkjet recording apparatus 100 comprises a rotating transfer drum 33*b* which functions as an intermediate transfer recording medium, and a pressurizing/transferring member 350 which pressurizes an image formed on the rotating transfer drum 33*b* so as to transfer the image to the recording medium 16.

More specifically, during printing from the print heads 50 to the rotating transfer drum 33*b*, the pressurizing/transferring member 350 and the recording medium 16 are separated from the rotating transfer drum 33*b*. On the other hand, after recording of all images to the rotating transfer drum 33*b* is completed, the pressurizing/transferring member 350 immediately presses the recording medium 16 against the rotating transfer drum 33*b* so that the images are transferred.

Hereinafter, terminologies used in a following description will be explained.

A term "interference of deposited droplets" means that when dots deposited onto the recording medium 16 overlap, the dots formed by the liquid droplets on the recording medium are joined together or mixed with each other before the dots are fixed after deposition, causing deformation of the dot shape and uneven mixing of different colors of inks, whereby image degradation occurs.

A term "overlap degree of dots" is a physical quantity which indicates a degree to which the adjacent dots overlap to each other.

In the present embodiment, the number of dots overlapping to each other (also referred to as a "number of overlaps") is described as an "overlap degree of dots".

Figure 2A:
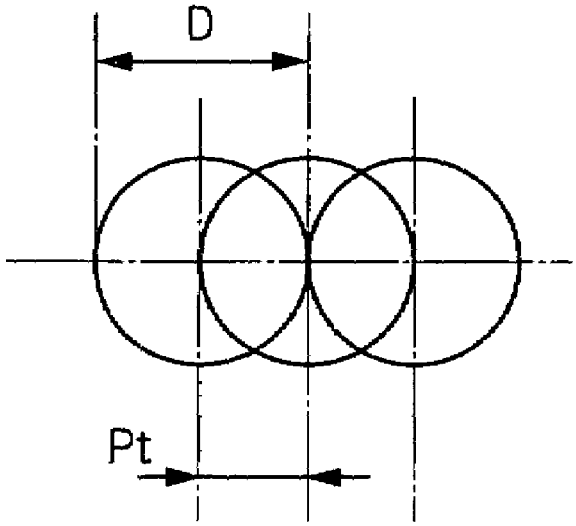
FIG. 2A is a an illustrative diagram when an overlap degree of dots is "2"

For example, as shown in FIG. 2A, when adjacent dots do not overlap with each other while two dots overlap with each other in the sub-scanning direction, that is, when a relationship of a distance Pt between the centers of adjacent dots to a diameter D of each of dots is expressed as $D/2 \leqq Pt < D$, the overlap degree of dots can be expressed as Vn=2.

Figure 2B:
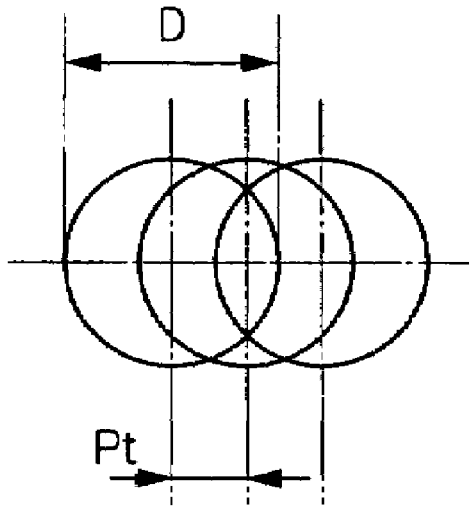
FIG. 2B is an illustrative diagram when an overlap degree of dots is "3"

Moreover, for example, a shown in FIG. 2B, when adjacent dots do not overlap to each other while the three dots overlap each other in the sub-scanning direction, that is, when the relationship of the distance Pt to the diameter D is expressed as $D/3 \leqq Pt < D/2$, the overlap degree of dots can be expressed as Vn=3.

In the case of using a plurality of kinds of dot diameters, an "overlap degree of dots" is described as a degree of overlapping dots which are obtained when using the largest dot diameter.

A term "fixing of dots" means that: (1) an ink liquid droplet on the surface of a recording medium becomes solidified (or cured) (in other words, surface solidification type of fixing); and (2) an ink liquid droplet on the surface of the recording medium penetrates through the recording medium (in other words, penetration type of fixing). In both of (1) and (2), the liquid droplet no longer exists on the surface of the recording medium.

In the "penetration type", the fixing time at which the ink is fixed on the recording medium is determined by the penetration characteristics. More specifically, the fixing time is determined mainly according to combination of an ink type and a recording medium type.

In an experiment, it is proven that when ink liquid droplets no longer exist on surface of a recording medium due to penetration of droplets, even if the ink solution which has penetrated through the recording medium is not dried completely, the ink solution (color material) has fixed on an image receiving layer inside the recording medium, and hence interference of deposited dots hardly occurs. Therefore, in the present invention, the fixing time of the penetration type is defined as a time until the ink liquid droplet on the surface penetrates completely. Even if the solution in the recording medium is not dried, it has no relation to interference of deposited dots.

In the "surface solidification type", the fixing time is determined by the drying characteristics of ink and the solidification (curing) characteristics of ink, such as the energy curing characteristics. The fixing time is determined mainly by an ink type, UV (ultraviolet) radiation energy, heat energy, environmental conditions such as temperature and humidity, and the like.

If the ink liquid droplets on the surface of the recording medium no longer exist, interference of the deposited dots hardly occurs. Accordingly, the ink liquid droplets are not solidified completely, but are in a state of a semi-solid solution. Therefore, in the present invention, the definition of fixing time by the surface solidification type is a solidifying (curing) time until the liquid droplets on the surface no longer exist.

Figure 3:
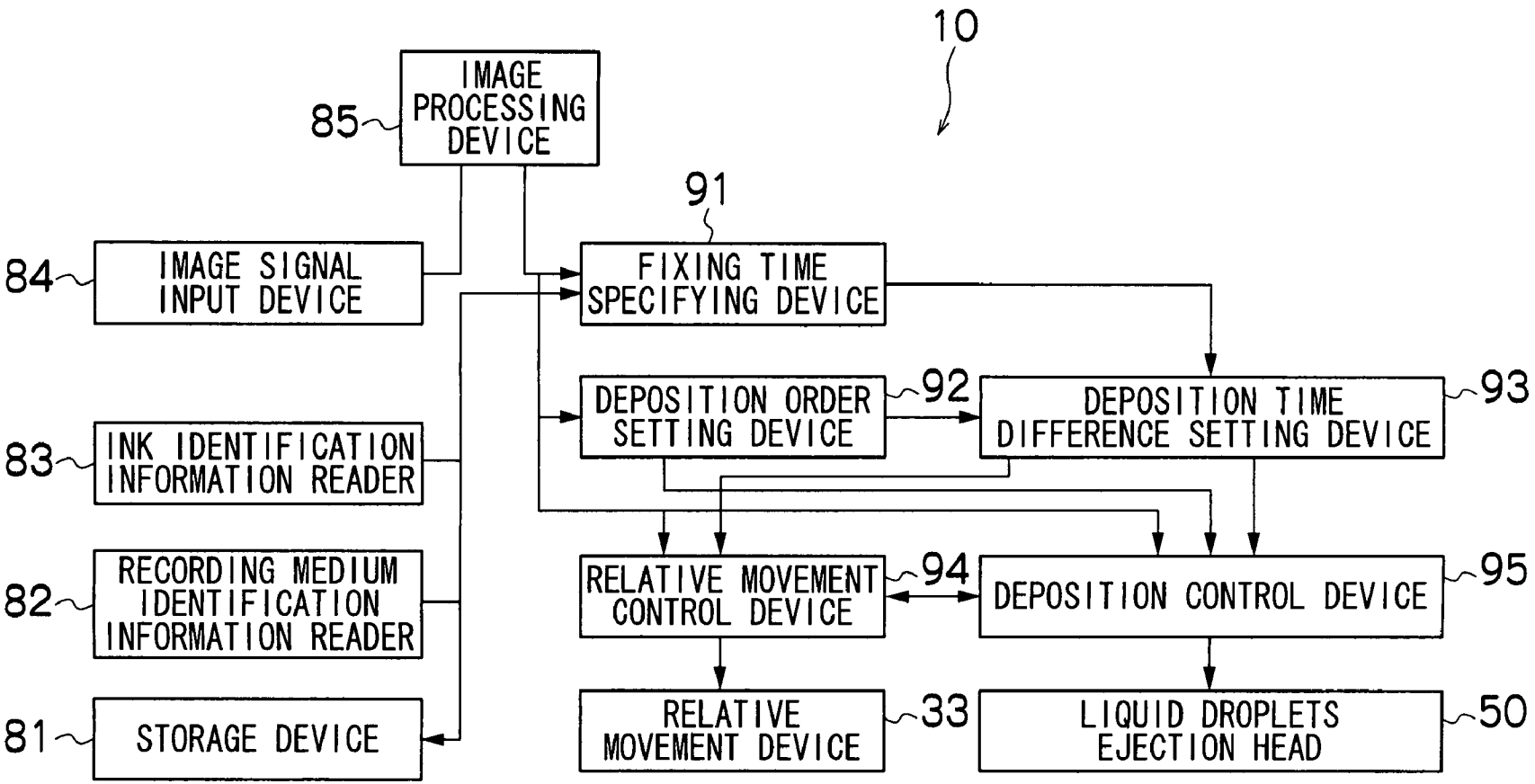
FIG. 3 is a block diagram showing a functional constitution of the inkjet recording apparatus according to the embodiment.

FIG. 3 is a block diagram showing a functional constitution of the inkjet recording apparatus 10 according to the embodiment.

As shown in FIG. 3, the image forming apparatus 10 comprises: the relative movement device 33; the liquid droplets ejection heads 50; a storage device 81; a recording medium identification information reader 82; an ink identification information reader 83; an image signal input device 84; an image processing device 85; a fixing time specifying device 91; a deposition order setting device 92; a deposition time difference setting device 93; a relative movement control device 94; and a deposition control device 95, and the like.

The liquid droplets ejection heads 50 have a plurality of nozzles arranged in at least the main scanning direction, and eject the liquid droplets toward a recording medium such as a paper from a nozzle selected from the plurality of nozzles according to a predetermined image signal, so that an image comprising a plurality of dots which correspond to the image signal is formed on the recording medium 16.

The relative movement device 33 relatively moves the liquid droplets ejection heads 50 and the recording medium 16 to each other several times in the sub-scanning direction, so that the liquid droplets ejection head 50 is caused to scan with respect to the recording medium 16 several times.

In other words, the relative movement device 33 in the present embodiment moves the liquid droplets ejection heads 50 and the recording medium relatively to each other in the sub-scanning direction, so that droplets are ejected so as to overlap adjacent dots to each other in at least the sub-scanning direction.

Preferably, the relative movement device 33 uses a rotating drum (rotating body) which moves the wrapped recording medium relatively with respect to the liquid droplets ejection heads 50 by moving the recording medium on a predetermined circumference, for example.

The storage device 81 stores information related to image formation. For example, the storage devices stores table information which is necessary for specifying the fixing time for each dot. The table information will be described in detail hereinafter.

The recording medium identification information reader 82 reads in identification information (ID) capable of identifying a type of a recording medium from a medium storing magazine which stores the recording medium.

The ink identification information reader 83 reads in identification information (ID) capable of identifying a type of ink from an ink cartridge which stores the ink.

There are various reading modes for reading in the identification information by the recording medium identification information reader 82 and the ink identification information reader 83: wireless reading from a wireless tag (also referred to as "RFID") or the like; optical reading; magnetic reading.

The image signal input device 84 is a device to which an image signal is inputted from a host computer (not shown). The image signal includes image data subjected to image formation, and information indicating the output resolution.

The image processing device 85 performs various image processing on image data which is inputted to the image signal input device 84. As a result of the image processing performed by the image processing device 85, the output resolution may be changed. Furthermore, the image processing device 85 computes an overlap degree of dots according to the output resolution (or dot pitch), a desired grayscale toning and the like.

Here, for the degree of overlapping, there is an overlap degree Vs indicating the degree of overlapping dots in the sub-scanning direction (a degree in which the dots overlap in the sub-scanning direction), an overlap degree Vm indicating the degree of overlapping dots in the main scanning direction (a degree in which the dots overlap in the main scanning direction), an overlap degree $V\alpha$ indicating the degree of overlapping dots in the direction oblique to the sub-scanning direction (a degree in which the dots overlap in the oblique direction).

The fixing time specifying device 91 specifies a fixing time for each dot (dot unit) in the recording medium based on the table information stored in the storage device 81.

More specifically, the recording medium identification information read by the recording medium identification information reader 82, the ink identification information read by the ink identification information reader 83, and the dot diameter and the like are used as parameters to specify the fixing time of each of dots.

The parameters described above differ according to the fixing modes of dots (i.e., whether the fixing mode is the penetration type or surface solidification type). Therefore, the different table information for each fixing mode of dots is provided, and then the type of parameter and the table information to be referred to are switched by specifying a fixing mode of dots according to the ink identification information or the like.

The deposition order setting device 92 is a device which sets a deposition order of dots.

The deposition order setting device 92 sets a deposition order of dots in the sub-scanning direction according to the overlap degree of the adjacent dots in at least the sub-scanning direction. For example, a deposition order of dots in the sub-scanning direction is set according to the fixing time for each dot, output resolution in the sub-scanning direction, and the overlap degree of adjacent dots in the sub-scanning direction.

Moreover, when ejection is performed so that adjacent dots overlap to each other in both the sub-scanning direction and main scanning direction, the deposition order setting device 92 sets a deposition order of dots to prevent the shapes of the overlapping adjacent dots in all of the sub-scanning direction, main scanning direction, and oblique direction from deforming.

There are various setting modes for a deposition order in consideration of the sub-scanning direction, main scanning direction, and oblique direction.

As a first mode for setting a deposition order, an overlap degree $V\alpha$ of dots in the oblique direction is noted, and therefore, a deposition order of dots in the sub-scanning direction and main scanning direction is set according to the overlap degree $V\alpha$.

In the present embodiment, the number of dots overlapped with a specific dot (noted dot) in the direction oblique to the sub-scanning direction is used as an overlap degree $V\alpha$ of dots in the oblique direction.

Here, the overlap degree $V\alpha$ of dots in the oblique direction in the present embodiment will is described in further detail. A plurality of dots arrayed in the sub-scanning direction are described as a "line", and a plurality of dots arrayed in the main scanning direction are described as a "row". In this case, dots in the i-th line (sub-scanning direction) and dots in the j-th row (main scanning direction) are noted. In the (i+1)-th line, in other words, in the sub-scanning line next to the sub-scanning direction belonging to the noted dots, the main scanning line in which the dots overlap with the noted dots (an i-th line, a j-th row) is examined. In the (i+1)-th line, when examining the dots in the j-th row, the dots from the j-th row to the $(j+V\alpha-1)$-th row overlap with the noted dots while the dots in the $(j+V\alpha)$-th row do not overlap with the noted dots. At this time, the overlap degree $V\alpha$ is a degree of overlapping dots in the oblique direction. In other words, in relation to the dots in the (i+1)-th line adjacent to the main scanning direction with respect to the noted dots (an i-th line, a j-th row), a state in which all of the dots from the j-th row as one dot to $V\alpha$-th dot in the sub-scanning direction overlap with the noted dots is defined as the overlap degree $V\alpha$ of dots in the oblique direction. In the present paragraph, though the "line" and the "row" are defined for convenience in order to explain the overlap degree $V\alpha$ of dots in the oblique direction, the plurality of dots arrayed in the sub-scanning direction are referred to as "dots row" except for the present paragraph.

When an overlap degree of dots in the oblique direction is $V\alpha$ and an overlap degree of dots in the main scanning direction is Vm, in order to form a solid image on the recording medium, a row of dots in the sub-scanning direction is divided into $(V\alpha \times Vm)$ dots as a basic unit M so as to deposit with $(V\alpha \times Vm-1)$ dots interval in the sub-scanning direction, and a phase difference of $V\alpha$ dots is set between the adjacent dots so as to deposit with $(Vm-1)$ dots interval in the main scanning direction.

As described above, the dot arrangement in which the plurality of dots are arrayed two-dimensionally in the sub-scanning direction and the main scanning direction is divided into N groups with $(V\alpha \times Vm)$ dots as a basic unit M. Such grouping is called "grouping into (N×M) arrays". For example, in FIG. 11 described hereinafter, a cluster of successive arranged dots from 1 st to 9th in the sub-scanning direction is defined as a "group". Therefore, M $(=V\alpha \times Vm)$ dots arranged successively in the sub-scanning direction are assigned to one group.

In addition, in the sub-scanning direction, dots in each group from the 1st group to the N-th group are sorted into the first block through the M-th block sequentially. When actually depositing dots, first, only dots in the first block from the first group to the N-th group are deposited continuously. Next, only dots in the second block from the first group to the N-th group are deposited continuously. Finally, only dots in the M-th block from the first group to the N-th group are deposited continuously. At this time, the dots are deposited with $(V\alpha \times Vm-1)$ dots interval in the sub-scanning direction. Therefore, the dots deposited continuously by the nozzles within one rotation of the rotating drum 33 (rotating body) belong to the same block. For example, in FIG. 11 described hereinafter, the dots applied with the same number are defined as dots in the same group.

As a second mode for setting a deposition order, although the overlap degree $V\alpha$ of dots in the oblique direction is not noted, a deposition order of dots in the sub-scanning direction and the main scanning direction is set according to mainly the overlap degree Vs of dots in the sub-scanning direction and the overlap degree Vm of dots in the main scanning direction.

More specifically, in order to form a solid image on the recording medium, when the number of dots in the sub-scanning direction is "Vs" and the number of dots in the main scanning direction is "Vm", the dot arrangement arrayed two-dimensionally in the main scanning direction and the sub-scanning direction on the recording medium is grouped with (Vs×Vm) two-dimensional block. Therefore, while the dots are deposited with $(Vs-1)$ dots interval in the sub-scanning direction, the dots are deposited with $(Vm-1)$ dots interval in the main scanning direction, thereby setting the deposition order.

In addition, it is also possible to set a deposition order according to parameters other than the overlap degrees Vs, Vm, and $V\alpha$.

For example, it is preferable to set deposition orders of dots in the sub-scanning direction and the main scanning direction according to the fixing time of each dot, the overlap degree of dots in the main scanning direction, and the overlap degree of dots in the oblique direction.

The deposition time difference setting device 93 sets a difference between deposition times of the adjacent dots so that the difference between the deposition times of the adjacent dots overlapping each other is equal to or more than the fixing time of each dot specified by the fixing time specifying device 91.

The deposition time difference setting device 93 sets an ejection cycle of the nozzles according to the deposition order set by the deposition order setting device 92.

The relative movement control device 94 is a device which moves the recording medium and the liquid droplets ejection heads 50 relatively by means of the relative movement device 33.

Furthermore, the relative movement control device 94 changes the setting of the relative movement speed in the relative movement device 33. For example, if the relative movement device 33 is constituted by a rotating drum, the relative movement control device 94 changes the setting of the rotation speed (also referred to as number of rotations) in the rotating drum 33, according to the output resolution or the fixing time of each dot of the nozzle. At this time, the deposition time difference setting device 93 sets a nozzle ejection cycle, while the relative movement control device 94 sets rotation speed of the rotating drum 33, according to a set nozzle ejection cycle, the output resolution, and the fixing time.

The deposition control device 95 controls deposition from the nozzles of the liquid droplets ejection heads 50 according to an image signal. During the deposition, the deposition control device 95 controls the deposition from the nozzles of the liquid droplets ejection heads 50 according to the deposition order, which is set by the deposition order setting device 92, and the difference between the deposition times of adjacent dots, which is set by the deposition time difference setting device 93.

Furthermore, the deposition time difference setting device 93 sets an ejection cycle of the nozzles of the liquid droplets ejection heads 50 corresponding to the deposition order set by the deposition order setting device 92, according to a fixing time $T_{fix}$ of each dot from the nozzles, a passing time $T_{pass}$ when the liquid droplets ejection heads 50 pass a portion in which the recording medium is not present, and a number N of groups.

The mode for setting a nozzle ejection cycle according to the fixing time $T_{fix}$ at which a dot is fixed completely is described above. However, even if a dot is not fixed completely, it is preferable to set a nozzle ejection cycle according to the semi-fixing time $T_{semi}$ ($T_{semi}<T_{fix}$) during which the deterioration of the dot shape due to interference is within the allowance range in terms of the image quality.

Next, the table information which has stored in the storage device 81 in advance is described below.

When the fixing of dots is "penetration type", the table information is previously created a time required for penetration as the fixing time, according to parameters such as a type of ink, a type of recording medium, and the dot diameter. Then, this table information is stored in the storage device 81 in advance. Alternatively, it is also possible to create table information with additional parameters of environmental conditions such as temperature and humidity, so as to store in the storage device.

The penetration time (fixing time) determined by combining the ink type and the recording medium type is affected specifically by conditions (ink conditions and recording medium conditions) such as the surface tension of the ink, the ink viscosity, the radius of the capillary tube of the recording medium, and the angle of contact between the ink and recording medium. Therefore, the relationship between those conditions and the penetration time is examined or experimented for various inks and recording media used in image formation, and then the table information is preferably created according to the result of the examination or experiment.

Figure 4:
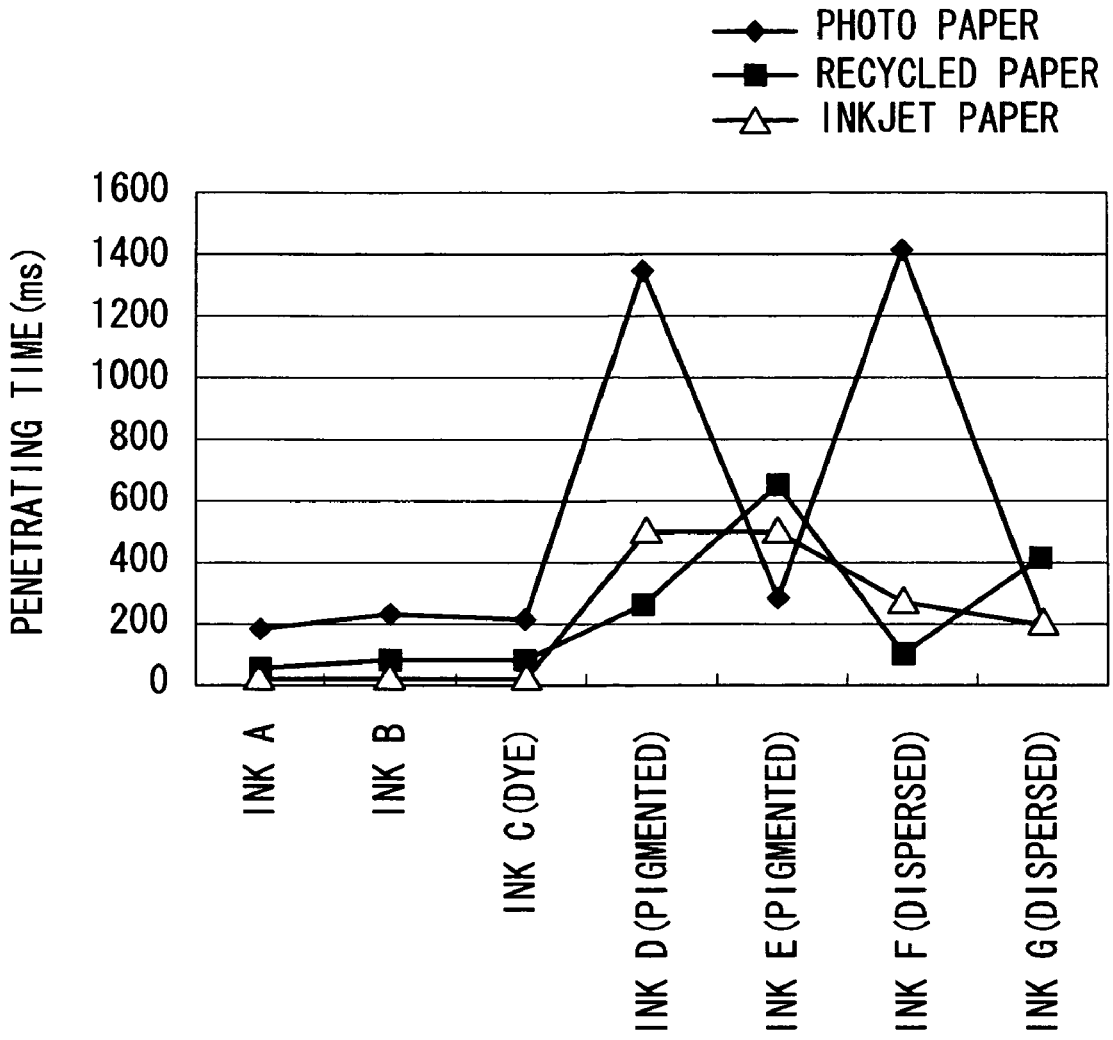
FIG. 4 is a graph showing a relationship between a penetration time as a fixing time when fixing of dots is penetration type, an ink type, and a recording medium type.

FIG. 4 shows a relationship between a combination of each ink type and each recording medium type and a measuring result of the penetration time, in the case in which fixing of dots is the penetration type.

In FIG. 4, the horizontal axis shows ink types, and the vertical axis shows average values of penetration times measured a number of times for each combination of the ink and the recording medium. Measurement is performed for combinations of seven types of inks and three types of recording media. The sizes of ink droplets differ in the range of 120 to 190 pl depending on each type of ink.

When inkjet paper or photo paper is used, a difference between the penetration times of a dye ink (e.g., ink C) and a dispersed ink (e.g., ink F) is several times (approximately twice to nine times). When measurement is performed using an ink E (pigmented ink) or an ink G (dispersed ink of medium viscosity), the time for penetration into the photo paper is shorter as compared to the inkjet paper or recycled paper; however, it is considered that this measurement is performed on the surfaces of the papers that collected the inks.

For the recycled paper, it is considered that the influence of the particle size of the dispersed ink is small, since the size of the voids of the recycled paper is largest.

When the fixing of dots is "surface solidification type", the table information is created a time required for solidification as the fixing time according to parameters such as a type of ink, a type of recording medium, the dot diameter, energies required for solidification such as UV (ultraviolet) radiation energy and heat energy, and environmental conditions such as temperature and humidity. Then, this table information is stored in the storage device 81 in advance.

Figure 5:
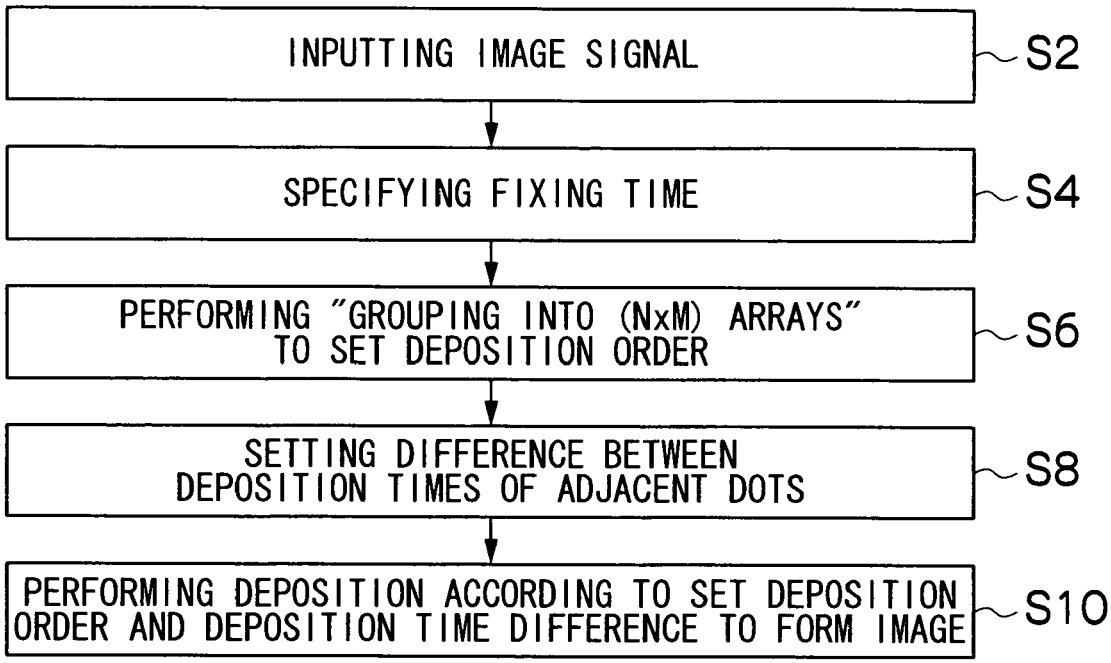
FIG. 5 is a flow chart showing a sequence of a first mode of image formation processing according to the embodiment.

Next, a fist example of a sequence of image formation processing in the image forming apparatus 10 according to the present embodiment will be described according to a flow chart in FIG. 5.

Hereinafter, a case of depositing a solid image is described, which is the severest condition regarding interference of deposited dots. A solid image is described as an example to facilitate understanding of the present invention, and it goes without saying that images other than solid images can be formed by selectively ejecting inks from the nozzles according to the image signal in actuality. Furthermore, a deposition algorithm for preventing interference of deposited dots in the sub-scanning direction will be described. Moreover, a case of a single-colored ink is described, but similar deposition control can be performed for each color of ink even if inks of a plurality of colors are used.

First, an image signal is inputted from a host computer or the like to the image signal input device 84 (step S2).

The image signal generally includes data indicating an image to be formed on the recording medium (image data) and an output resolution Rs. Sometimes the image data is edited in the image forming apparatus 10 to determine the output resolution.

Next, the fixing time specifying device 91 specifies the fixing time $T_{fix}$ for each dot (step S4).

More specifically, the table information previously stored in the storage device 81 is used to specify the dot fixing time $T_{fix}$ according to the parameters for image formation, such as the ink type, the recording medium type, and the diameter of dot.

For example, the ink type information is acquired by reading the identification information indicating the type of ink from an ink cartridge (not shown) which can be attached to or removed from the image forming apparatus 10. The recording medium type information is acquired by reading the identification indicating the type of recording medium from the recording medium type. There are various modes for reading the identification information indicating the ink type or the recording medium. They can be read wirelessly, magnetically, or optically, for example. The diameter of each dot is specified by a nozzle drive signal generated through the image processing from image data. On the other hand, the ejection amount (ejection volume) from the nozzles is determined by the ink and recording medium. Even if the same of nozzle, the same ink, and the same recording medium are used, the dot diameter can be changed by switching the ejection mode for ejecting from the nozzles.

Next, a row of dots formed in the sub-scanning direction on the recording medium is grouped into (N×M) arrays by the deposition order setting device 92 according to the overlap degree Vn of dots (step S6).

Specifically, when a row of dots in the sub-scanning direction is formed on the recording medium by depositing from the nozzles of the liquid droplets ejection head 50 while moving the liquid droplets ejection head 50 and the recording medium relatively, and the formed row of dots in the sub-scanning direction is divided into a plurality of groups. More specifically, the row of dots in the sub-scanning direction is divided into N groups, with M dots arrayed continuously as the basic unit. Hereinafter, dividing the row of dots in the sub-scanning direction into N groups of M dots as the basic unit is called "grouping into (N×M) arrays".

Figure 6A:
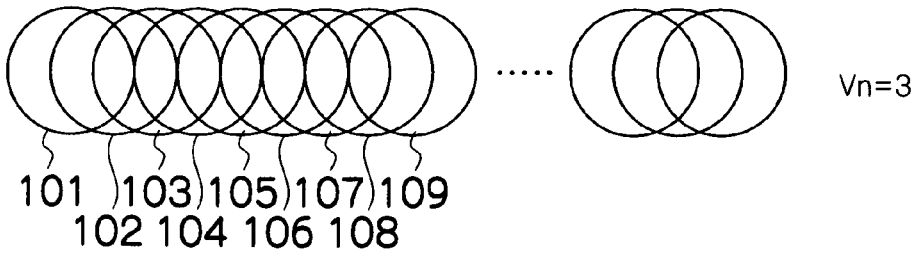
FIG. 6A is an illustrative diagram showing a row of dots in the sub-scanning direction when the overlap degree of dots is "3"

Next, a row of dot in which the overlap degree Vn of dots (number of overlapping dots) is "3" will be described as an example of "grouping into (N×M) arrays", as shown in FIG. 6A.

In FIG. 6A, a first dot 101 as the starting dot in the row of dots overlaps with a second dot 102 and a third dot 103, but does not overlap with a fourth dot 104. Specifically, although the i-th dot from the starting dot in the row of dots overlaps with (Vn−1)-th dot following the i-th dot, it does not overlap with (i+Vn)-th dot.

Figure 6B:
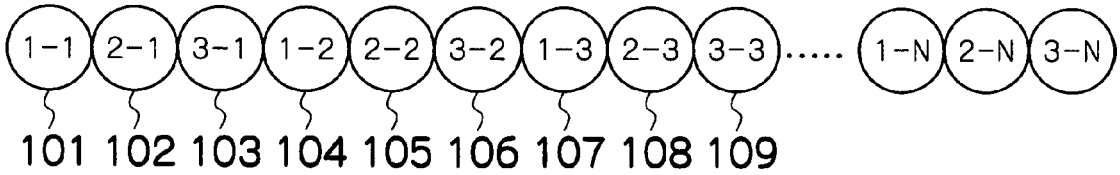
FIG. 6B is an illustrative diagram showing a state in which the dots do not overlap.

FIG. 6B is an illustrative diagram showing a state in which the dots in the row of dots shown in FIG. 6A do not overlap to each other for descriptive purposes. However, the row of dots in FIG. 6B is simply shown so that the dots do no overlap to each other for descriptive purposes, but the overlap degree Vn in the row of dots in FIG. 6B is "3" as shown in FIG. 6A.

In this case, since the overlap degree Vn is "3", one group is configured every "3" dots from the starting dot in order to form N groups. Specifically, a group formed into (N×M) arrays is formed as the basic unit (M=Vn). For example, sequentially, the first group is formed by the first to third dots 101 to 103 from the starting row of dots, the second group is formed by the fourth to sixth dots 104 to 106, and the third group is formed by the seventh to ninth dots 107 to 109, so that the N groups are configured in which one group consists three successive dots. In other words, a group having Vn dots is formed sequentially from the starting dot in the row of dots. When the total number of dots in the row cannot be divided by the overlap degree Vn, the number of dots in the last group (the N-th group) is less than D (one or two in this example). Hereinafter, the dot that actually does not exist in the last group is referred to as "dummy dot".

In the row of dots which is grouped into (N×M) arrays, the ejection order for each dot is determined as follows. For example, the first deposition block consisted only of the first dots (101, 104, 107 . . . ) in each group of the first to N-th groups is firstly deposited sequentially, the second deposition block consisted only of the second dots (102, 105, 108 . . . ) in each group of the first to N-th groups is then deposited sequentially, and the M-th deposition block consisted only of the M (M=3) dots (103, 106, 109) in each group of the first to N-th groups is finally deposited sequentially. In other words, M blocks of the m-th deposition block consisted only of the m-th dots (1≦m≦M) in each of the groups are formed, and deposition is sequentially performed from the first deposition block to the M-th deposition block. In each deposition block, the deposition is performed with (M−1) dots interval.

Figure 7A:
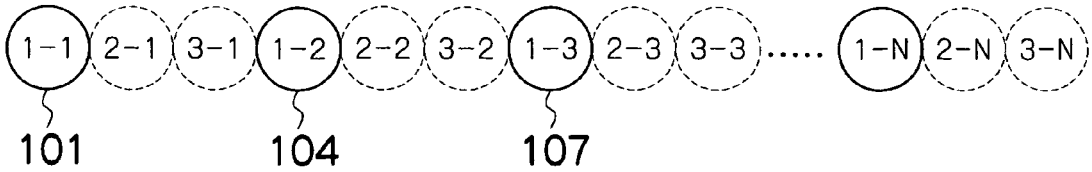
FIG. 7A to 7C are illustrative diagrams of dots rows grouped into (3×N) arrays in the sub-scanning direction, FIG. 7A showing a solid line as a first deposited group, FIG. 7B showing a solid line as a second deposited group, and FIG. 7C showing a solid line as a third deposited group.
Figure 7B:
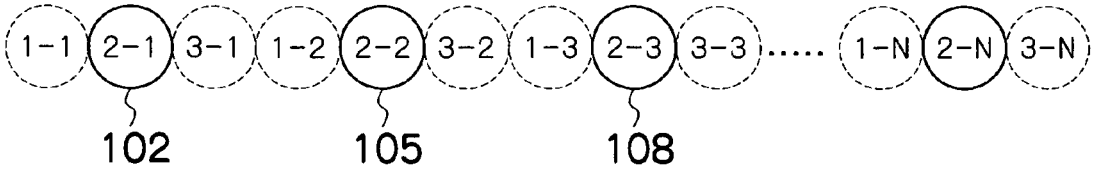
Figure 7C:
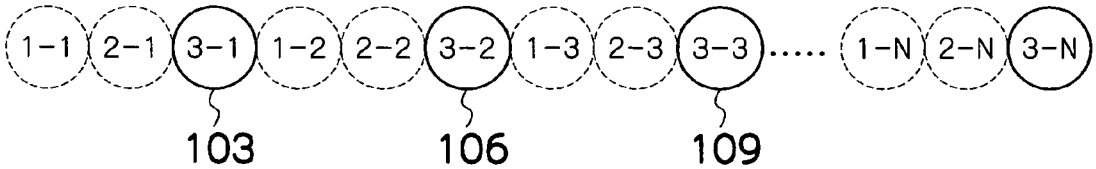

When the overlap degree Vn is "3" and (N×M) arrays are grouped with the basic unit (M=Vn) as shown in FIG. 6A, the dots configuring the first deposition block (101, 104, 107 . . . ) are shown with solid lines in FIG. 7A, the dots configuring the second deposition block (102, 105, 108 . . . ) are shown with solid lines in FIG. 7B, and the dots configuring the third deposition block (103, 106, 109 . . . ) configuring the third block (i.e., the M-th deposition block) are shown with solid lines in FIG. 7C.

Sometimes, the overlap degree Vn of dots is changed according to an image to be outputted even if the same ink and same recording medium are used. For example, the overlap degree Vn is changed according to the output resolution Rs (the inverse number of the dot pitch Pt). Therefore, grouping may be performed directly according to the output resolution Rs (or dot pitch Pt), and the present invention includes such a manner.

Moreover, although the description of the row of dots in the sub-scanning direction is omitted here, it goes without saying that grouping may be performed for the row of dots in the main scanning direction.

As described above, after specifying (step S4) the fixing time $T_{fix}$ for each dot and grouping (step S6) the row of dots in the sub-scanning direction, the difference Td between the deposition times of the adjacent dots overlapping to each other in the sub-scanning direction (the difference between the deposition times of the adjacent dots) is set by the deposition time difference setting device 93 (step S8).

More specifically, the difference Td between the deposition times of adjacent dots is set according to the fixing time $T_{fix}$ of each dot and the overlap degree Vn of dots. The difference Td between the deposition times of adjacent dots is set to the minimum as much as possible, in order to realize high speed printing.

For the convenience of explanation, given the case in which the fixing time of each dot $T_{fix}$ is not considered, the difference Td between the deposition times of adjacent dots can be expressed in a following inequality (1):

$$Tb \geqq T_{jet} \times N + \alpha. \quad (1)$$

In this inequality (1), $T_{jet}$ is the smallest ejection cycle of the nozzles, N is the number of groups which are set in the grouping process of the step S6, and α is a shortest rotation time in the rotating drum 33, corresponding to the sum of the distance of a portion in which the circumference of the rotating drum 33 is not wrapped by the recording medium, and the distance of a margin in the recording medium in which an image is not formed.

In addition, the group number N can be also expressed in N=K/M. Herein, K is the total number of dots in the sub-scanning direction, and the M is the basic unit which is set in the grouping process of the step S6. Therefore, the inequality (1) can be expressed in a following inequality (2):

$$Td \geqq T_{jet} \times K/M + \alpha. \quad (2)$$

Since the overlap degree Vn is used with M as a basic unit of group, then the relationship between the basic unit M and the overlap degree Vn establishes M=Vn, and hence the inequality (2) can be expressed in a following inequality (3):

$$Td \geqq T_{jet} \times K/Vn + \alpha. \quad (3)$$

On the other hand, in consideration to the fixing time $T_{fix}$ of each dot, the condition to avoid interference of deposited dots can be expressed in a following inequality (4):

$$Td \geqq T_{fix}. \quad (4)$$

In the inequality, $T_{fix}$ is the fixing time of each dot, which is specified in the step S4.

Therefore, the difference Td between the deposition times of adjacent dots satisfies the inequality (3) shown above, and is set to a value which satisfies the inequality (4) shown above. In the case of placing significance on high-speed printing, the difference between the deposition times is set to the minimum value for satisfying the both inequalities.

Herein, the description is provided for a case in which an image to be formed is a solid image, and the length of the recording medium in the sub-scanning direction in is fixed (i.e., the recording medium of the uniform size is moved relatively with respect to the liquid droplets ejection head in the same direction). Therefore, the maximum number K of dots in the sub-scanning direction is considered as the fixed value. In addition, $\alpha$ is also considered as a fixed value. In this case, the difference Td between the deposition times of adjacent dots can be calculated with the fixing time $T_{fix}$ and the overlap degree Vn as variable parameters.

Alternatively, if there are other variable parameters besides the fixing time $T_{fix}$ of each dot and the overlap degree Vn of dots, it goes without saying that such variable parameters is preferably considered to calculate the difference Td between the deposition times of adjacent dots. For example, when an image to be formed is not a solid image, generally, K is also variable. Moreover, if the size of each image or the size of each recording medium differs, then $\alpha$ is also variable other than K.

Furthermore, when the maximum rotation cycle of the rotating drum 33 is "$T_{jet} \times N + \alpha$", in other words, when it is shorter than the right-hand side of the inequality (1) (for example, when the length of the recording medium in the sub-scanning direction is large, or the rotation performance of the rotating drum 33 is low), it should be noted that the maximum rotation cycle (or the maximum revolutions per minute, i.e., rpm) is taken into further consideration to calculate the deposition time difference Td.

Moreover, it is described that the overlap degree Vn of dots is also a variable parameter. However, when the overlap degree Vn is fixed regardless of the output resolution Rs, it goes without saying that it may be treated as a fixed value instead of a variable parameter.

As described above, since the deposition is performed from the nozzles to the recording medium according to the deposition order which is set in the grouping process of the step S6 and the difference Td which is set in the step S8, an image is formed on the recording medium (step S110).

Each of the steps of the image formation processing described above is practically executed by a microcomputer according to a program previously stored in the storage device 81.

As described hereinafter, if the rotating drum 33 is formed so that the circumferential length L of the rotating drum 33 is made at an optimal value, it is possible to form an image at higher speeds.

For the convenience of explanation, it is assumed that a solid image is formed without generating a margin in the sub-scanning direction on the recording medium, while there is no portion on which the recording medium is wrapped around the rotating drum 33. More specifically, when a described above is not taken in to consideration, according to the inequalities (2) and (4), it is possible to establish a following inequality (5):

$$T_{fix} \leqq Td = T_{jet} \times K/M. \quad (5)$$

On the other hand, the length $Ld_{min}$ of a portion onto which the solid image is deposited (minimum drum circumferential length) can be expressed in a following equation (6):

$$Ld_{min} = K \times Pt. \quad (6)$$

In the equation (6), Pt is a dot pitch.

When the equation (6) is applied to the inequality (5) described above in order to solve for $Ld_{min}$, it is possible to obtain a following inequality (7):

$$Ld_{min} \geqq T_{fix} \times M \times Pt / T_{jet}. \quad (7)$$

In the inequality (7), for the ejection cycle $T_{jet}$ of the nozzles, the minimum value is set so that ejection can be performed by the nozzles in order to form an image at high speed. Furthermore, for the basic unit M of the group, the overlap degree Vn (number of overlapping dots) is set so as to form a high quality image. In addition, for the dot pitch Pt (the inverse number of the dot pitch Rs), the minimum value is set in order to deal with the high quality image mode. Moreover, for the fixing time $T_{fix}$ of each dot, a fixing time is set corresponding to combining the most used recording medium and the most used ink.

The circumferential length Ld of the rotating drum 33 is set by comparing the minimum drum circumferential length $Ld_{min}$ obtained in the inequality (7) to a length Lp of the recording medium in the sub-scanning direction (namely, with a recording medium length). For example, if the minimum drum circumferential length $Ld_{min}$ is shorter than the recording medium length Lp, the circumferential length Ld of the rotating drum 33 is set to the recording medium length Lp+$\beta$. Herein, $\beta$ is the length of a portion on which the recording medium is not wrapped around the rotating drum 33.

In this manner, the circumferential length Ld of the rotating drum 33 is set according to the fixing time $T_{fix}$ of each dot, basic unit M of the group, the output resolution Rs (or dot pitch Pt=1/Rs), and the nozzle ejection cycle $T_{jet}$.

Hereinafter, the drum circumferential length Ld will be described in detail using two cases (a case A and a case B). The cases A and B differ in relation to the fixing time $T_{fix}$ of each dot and the output resolution Rs, but are same in relation to the overlap degree Vn. Briefly speaking, in the case A, high-resolution image is outputted, and dots are fixed at high speed, briefly speaking. On the other hand, in the case B, low-resolution image is outputted, and dots are fixed at low speed.

Case A

Dot fixing time: $T_{fix}$=30 ms

Overlap degree: Vn=3

Output resolution: Rs=2400 dpi (dot pitch Pt=10.6 μm)

Length of recording medium (A4) in the sub-scanning direction: Lp=300 mm

Total number of dots in the sub-scanning direction on recording medium (A4): K=Lp/Pt=28302 dots Nozzle ejection cycle: $T_{jet}$=40 μsec (25 kHz)

In the case A, dot fixing time $T_{fix}$ is specified for grouping into (N×M) arrays.

The overlap degree Vn (=3) is substituted for the basic unit M dot for grouping. Accordingly, the number N of groups is expressed in a following equation (8):

$$N = K/M = \frac{28302}{3} = 9434. \quad (8)$$

Furthermore, the minimum drum circumferential length $Ld_{min}$ is expressed in an equation (9):

$$Ld_{\min} = T_{fix} \times M \times Pt / T_{jet} = 0.030 \times 3 \times \frac{0.0000106}{0.000040} = 23.9 \text{ mm}. \quad (9)$$

In the case A, since a relationship between the minimum drum circumferential length $Ld_{min}$ and length of paper Lp can be established in $Ld_{min}$<Lp (=300 mm), it is sufficient if the actual drum circumferential length Ld is the length (Lp+β) of paper. It should be noted that β is the length of a portion on which the recording medium is not wrapped around the rotating drum 33. If the length β is sought in β=30 mm, the actual circumferential length Ld of the rotating drum 33 can be sought in Ld=300+30=330 mm. The rotating drum 33 having the circumferential length Ld obtained in such a manner is formed and then provided in the image forming apparatus 10 and 100.

Incidentally, in the case A, if the rotating drum 33 rotates once in a nozzle ejection cycle $T_{jet}$ of 40 μsec for the total dot numbers K=9434 in the sub-scanning direction of the paper, the number of rotations of the rotating drum 33 is calculated as 159 rpm. In this case, the peripheral velocity of the rotating drum 33 can be sought in a following equation:

(the circumferential length *Ld*)×(the number of rotations)=330 mm×159 rpm/60 sec=0.847 m/sec.

Case B

Dot fixing time: $T_{fix}$=60 ms

Overlap degree: Vn=3

Output resolution: Rs=240 dpi (dot pitch Pt=106 μm)

Length of recording medium (A4) in the sub-scanning direction: Lp=300 mm

Total number of dots in the sub-scanning direction on recording medium (A4): K=Lp/Pt=2832 dots Nozzle ejection cycle: $T_{jet}$=40 μsec (25 kHz)

In the case B described above, dot fixing time $T_{fix}$ is specified for grouping into (N×M) arrays, and then the overlap degree Vn (=3) is substituted for the basic unit M dot for grouping. Accordingly, the number N of group can be sought in a following equation (10):

$$N = K/M = \frac{2832}{3} = 944. \quad (10)$$

In this case, the groups are formed when the last two dots in the last group (N-th group) are dummy dots.

The difference Td between deposition times of adjacent dots is set according to the inequalities (3) and (4) described above.

Therefore, the minimum drum circumferential length Ld min can be sought in a following equation (11):

$$Ld_{\min} = T_{fix} \times M \times Pt / T_{jet} = 0.060 \times 3 \times \frac{0.0000106}{0.000040} = 477 \text{ mm}. \quad (11)$$

In the case B, when comparing the minimum drum circumferential length $Ld_{min}$ to the paper length Lp (300 mm), the relationship between the $Ld_{min}$ and the Lp can be expressed in Lp<$Ld_{min}$<Lp×2. Therefore, it is preferable that the actual drum circumferential length Ld is established in Ld=2×Lp+β. If the drum circumferential length Ld can be expressed in Ld=Lp+β, interference of deposited dots occurs unless the nozzle ejection cycle $T_{jet}$ is made large. If the nozzle ejection cycle $T_{jet}$ is made large, then the interference of deposited dots does not occur, but the image formation speed (printing speed) may be reduced.

Incidentally, in the case B, when the rotating drum 33 rotates once in a nozzle ejection cycle $T_{jet}$ of 40 μsec for the total number of dots K=944 in the sub-scanning direction of the paper K, the number of rotations of the rotating drum 33 is 1589 rpm. Therefore, the peripheral velocity of the rotating drum 33 can be sought in a following equation:

(circumferential length *Ld*)×(number of rotations)=630 mm×1589 rpm/60 sec=17 m/sec.

For example, in the image forming apparatus in which the cases A and B described above are used simultaneously, the case A or B used most frequently is prioritized to set the drum circumferential length Ld.

When the case (high-resolution image output, high-speed settling) is prioritized to set the drum circumferential length Ld, the deposition of dots is performed at a low-resolution image output by performing a setting change 1 or 2 described following, for example.

Setting Change 1

In the setting change 1, the nozzle ejection cycle $T_{jet}$ is fixed to 40 μsec, and the number of rotations in the rotating drum 33 during image formation is changed from 159 rpm to 1589 rpm.

Settings Change 2

In the setting change 2, the number of rotations in the rotating drum 33 during image formation is fixed to 159 rpm, and the nozzle ejection cycle $T_{jet}$ is changed from 40 μsec to 400 μsec.

Figure 8:
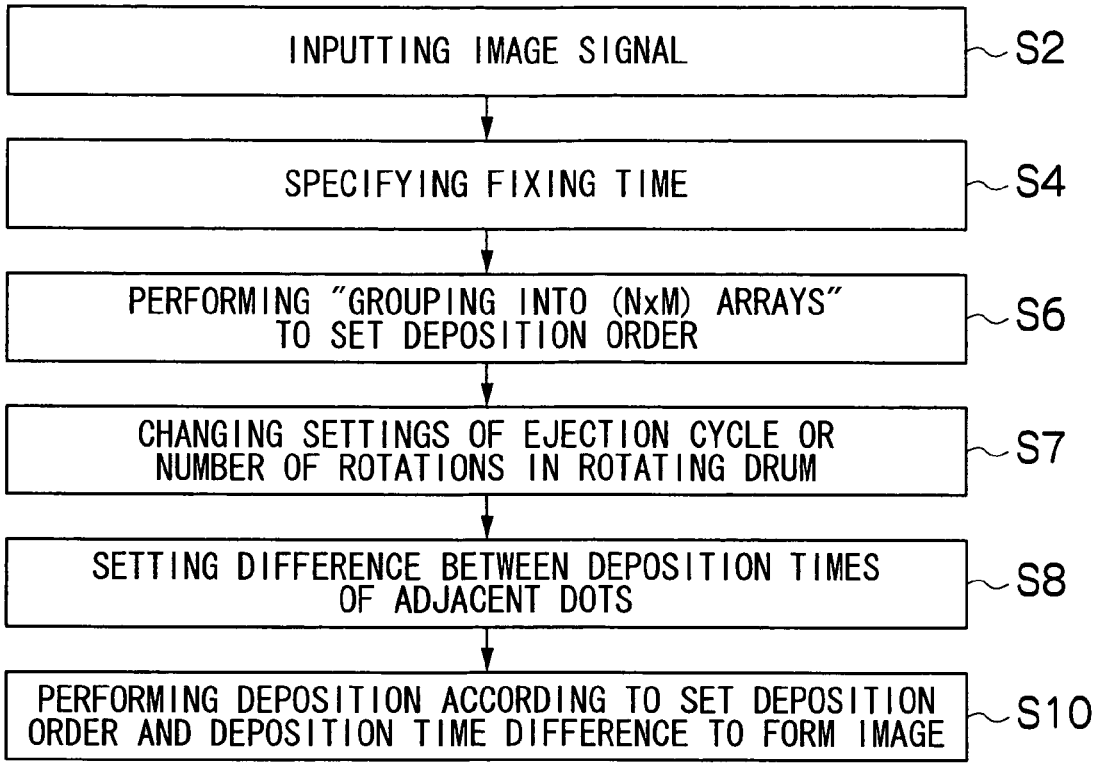
FIG. 8 is a flow chart showing a sequence of image formation processing according to a second embodiment of the present invention.

A sequence of a second example of the image formation processing for changing the settings is shown in a flow chart of FIG. 8.

As shown in FIG. 8, first, an image signal is inputted (step S2). Next, the table information stored in the storage device 81 is used to specify the fixing time of each dot $T_{fix}$ according to the parameters for image formation, such as the ink type, the recording medium type, and dot diameter (step S4). Next, a row of dots formed in the sub-scanning direction on the recording medium is grouped into (N×M) arrays according to the overlap degree Vn. (step S6). In the step S6, the overlap degree Vn is calculated in the image formation device 85, according to the output resolution Rs (or dot pitch Pt), a desired grayscale toning, and the like. Next, the setting of the nozzle ejection cycle $T_{jet}$ or the setting of the number of rotations in the rotating drum 33 is changed according to the output resolution Rs (or dot pitch Pt), and the like (step S7). Next, the difference Td between the deposition times of adjacent dots in the sub-scanning direction is set according to the fixing time $T_{fix}$ of each dot and the overlap degree Vn of the dots (step S8). Then, an image is formed on the recording medium by deposition from the nozzles to the recording medium according to the deposition order which is set in the grouping process of the step S6, and the difference Td between the deposition times of adjacent dots which is set in the step S8 (step S10).

Hereinafter, image formation time according to the present embodiment will be considered.

In the case in which the present invention is not adapted, when the fixing time $T_{fix}$ of each dot is set to $T_{fix}$=30 ms, and the total number K of dots in the sub-scanning direction is set to K=28301 dots, then the total time T1 in image formation with a single ink can be sought as a following equation:

$$T1=30\ \text{msec}\times 28301=849\ \text{sec.}$$

Furthermore, the total time T4 in image formation with CMYK four colors of inks can be sought as a following equation:

$$T4=849\ \text{sec}\times 4=3396\ \text{sec.}$$

On the other hand, in the case in which the present invention is adapted, all dots can be deposited so that an ejection cycle $T_{jet}$ is set approximately to $T_{jet}$=40 μsec, thus the total time T1 in image formation with a single color can be sought in a following equation:

$$T1=40\ \mu\text{sec}\times 28301=1.13\ \text{sec.}$$

Therefore, an image can be formed at high speed while preventing interference of deposited dots.

The total time T4 in image formation with CMYK four colors of inks can be sought in a following equation:

$$T4=1.13\ \text{sec}\times 4=4.52\ \text{sec.}$$

Figure 9:
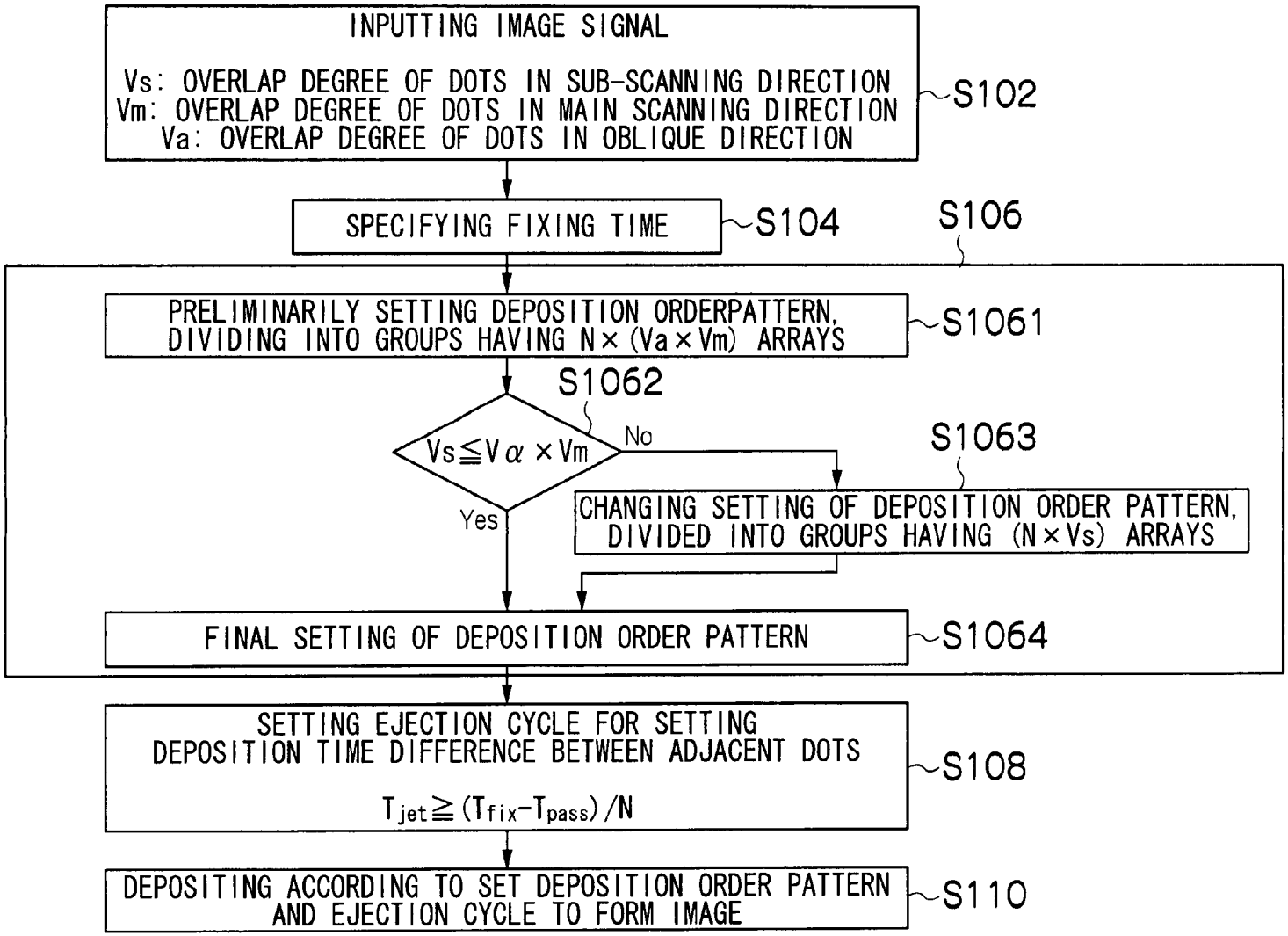
FIG. 9 is a flow chart showing a sequence of image formation processing according to a third embodiment of the present invention.

Next, the third mode of the image formation processing in the image forming apparatus 10 according to the present embodiment of the present invention will be described with reference to a flow chart of FIG. 9.

Hereinafter, a case in which a solid image is deposited will be described, which is the severest condition regarding interference of deposited dots. A solid image is described as an example to facilitate understanding of the present invention, and it goes without saying that images other than solid images can be formed by selectively ejecting inks from the nozzles according to the image signal in actuality. Moreover, the case of a single-colored ink is also described, but similar deposition control can be performed for each color of ink even if inks of a plurality of colors are used.

First, an image signal is inputted from a host computer or the like to the image signal input device 84 (step S102).

Generally, the image signal includes data of an image formed on the recording medium (image data), and the output resolution Rs. Sometimes, the image data is edited in the image processing device 85 in order to determine the output resolution.

In this case, an overlap degree of dots in the sub-scanning direction is Vs, an overlap degree of dots in the main scanning direction is Vm, and an overlap degree of dots in the oblique direction is Vα.

Next, the fixing time specifying device 91 specifies the fixing time $T_{fix}$ for each dot (dot unit) (step S104).

More specifically, the table information previously stored in the storage device 81 is used to specify the dot fixing time $T_{fix}$ according to the parameters for image formation, such as the ink type, the recording medium type, and the dot diameter.

For example, the type of ink is acquired by reading the identification information indicating the type of ink from an ink cartridge (not shown) which can be attached to or removed from the image forming apparatus 10. The type of recording medium is acquired by reading the identification indicating the type of recording medium from the recording medium. There are various modes for reading the identification information indicating the ink type or the recording medium type. They can be read wirelessly, magnetically, or optically, for example. The diameter of a dot is specified by a nozzle drive signal generated through the image processing from image data. On the other hand, the ejection amount (ejection volume) from the nozzles is determined by the ink and recording medium. Even if the same nozzles, the same ink, and the same recording medium are used, the dot diameter can be changed by switching the ejection amount for ejecting from the nozzles.

Next, the deposition order of dot patterns formed in the main scanning direction and the sub-scanning direction on the recording medium is grouped according to the overlap degree of dots by means of the deposition order setting device 92 (step S1106).

Herein, steps of the grouping process (step S106) in a mode for setting the deposition order according to the overlap degree Vα of dots in at least the oblique direction will be described in detail.

First, a deposition order mode showing the deposition order of dots is set preliminarily (step S1061).

Specifically, a group is formed with (Vα+Vm) as the basic unit M in the sub-scanning direction with successive (Vα+Vm) dots interval, so that deposition is performed with (Vα×Vm−1) dots interval according to the overlap degree Vα in the oblique direction and the overlap degree Vm in the main scanning direction. More specifically, the first dot through the (Vα×Vm)-th dots are assigned to the first group, and then a group is formed one by one with (Vα×Vm) dots interval for the rest of the dots.

In the main scanning direction, a phase difference of Vα dots is set between the adjacent dots in the main scanning direction so that deposition is performed for (Vm−1) dots interval according to the overlap degree Vm of dots in the main scanning direction. In this case, since the dots are arrayed by depositing so that the adjacent dots overlap to each other in the main scanning direction, the difference between the deposition times of the adjacent dots in the main scanning direction and the oblique direction can be set larger than the fixing time, thereby preventing interference of deposited dots.

Next, the overlap degree Vs of dots in the sub-scanning direction is compared with Vα×Vm (step S1062).

In the step S1062, if the relationship between the overlap degree Vs and the Vα×Vm is established in an inequality: Vs>Vα×Vm, then the deposition order mode which is set preliminarily is changed (step S1063). Specifically, a group is formed with Vs as the basic unit M in the sub-scanning direction with successive Vs dots interval so that deposition is performed with (Vs−1) dots interval according to the overlap degree Vs of dots in the sub-scanning direction. More specifically, the first dot through the Vs-th dot are assigned to the first group, and then a group is formed one by one with Vs dots interval for the rest of the dots. In the main scanning direction, a phase difference is set between the adjacent dots in the main scanning direction.

After forming groups as described above (steps S1061 and S1062), the final setting for the deposition order mode is performed (step S1064). In the step S1064, the deposition order modes are set for the deposition time difference setting device 93 and the deposition control device 95.

Next, in order to set the difference between deposition times of the adjacent dots, the nozzle ejection cycle $T_{jet}$ is set according to the deposition order set by the deposition order setting device 92 (step S108).

More specifically, the nozzle ejection cycle $T_{jet}$ is set so as to obtain $T_{jet} \geqq (T_{fix}-T_{pass})/N$. In the step S108, $T_{fix}$ is the fixing time specified in the step S4. $T_{pass}$ is a time when the liquid droplets ejection heads 50 passes a portion on which the recording medium is not wrapped around the recording drum 33. N is the number of groups. By setting the nozzle ejection cycle $T_{jet}$ in this manner, the difference between deposition times of the adjacent overlapping dots can be set to be at least the fixing time of each dot.

An image is formed on the recording medium by depositing from the nozzles to the recording medium in the nozzle ejection cycle $T_{jet}$ set in the step S8 according to the deposition order which is set in the grouping process of the step S6 (step S110). More specifically, the dots in the first block is deposited continuously in the ejection cycle $T_{jet}$ at the first rotation of the rotating drum 33, the dots in the second block are deposited continuously in the ejection cycle $T_{jet}$ at the second rotation f the rotating drum 33. In this manner, for the rest of the dots, the dots in the M-th block are deposited continuously in the ejection cycle $T_{jet}$ at the M-th rotation of the rotating drum 33.

Each of the steps of the image formation processing described above is executed by the microcomputer according to a program stored beforehand in the storage device 81.

Hereinafter, examples of grouping various dot patterns in the different overlap degrees (Vs, Vm, Vα) will be described.

Incidentally, it is assumed that any various examples described below satisfy following preconditions.

Precondition

Length of recording medium (A4) in the sub-scanning direction: Lp=300 mm

Output resolution: Rs=2400 dpi (dot pitch Pt=10.6 μm)

Total number of dots in the sub-scanning direction on recording medium (A4): K=Lp/Pt=28301 dots FIG. 10 shows a first example in a state of overlapping dots.

Figure 10:
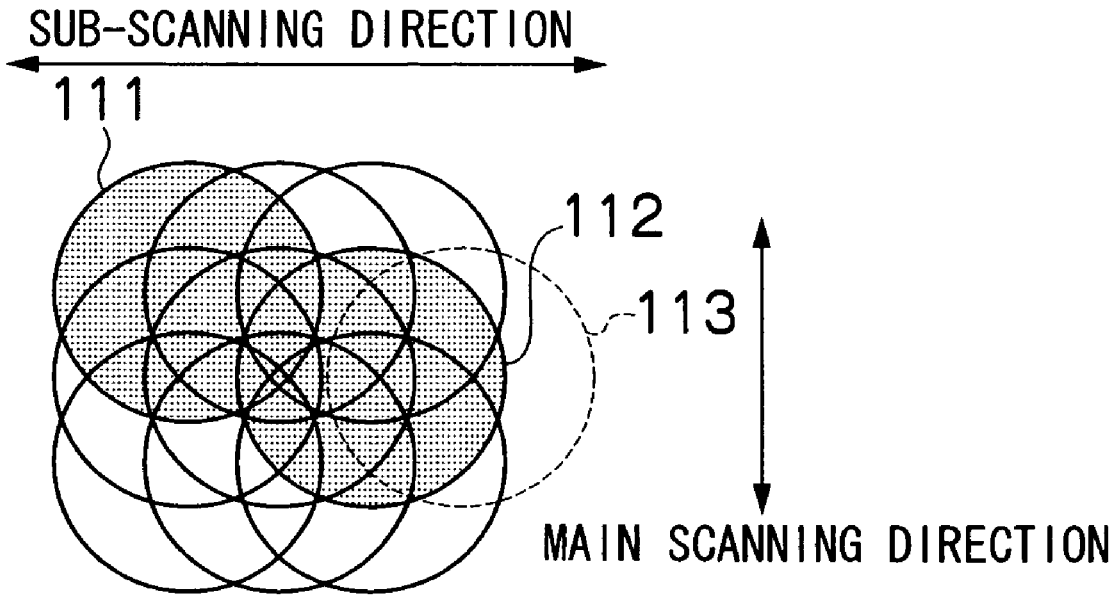
FIG. 10 is an illustrative diagram showing a first example in a state of overlapping dots.

In FIG. 10, the overlap degree Vs of dots in the sub-scanning direction is "3", and the overlap degree Vm of dots in the main scanning direction is "3".

When the position in which a target dot 111 is present is in a first sub-scanning line and a first main scanning row, the target dot 111 overlaps with a dot 112 which is in a third sub-scanning line in an adjacent main scanning row (second main scanning row), but does not overlap with a dot 113 which is in a fourth sub-scanning line in the aforementioned main scanning row (second main scanning row). In other words, the overlap degree Vα of dots in the oblique direction is "3". It should be noted in the present paragraph that "line" and "row" are defined for convenience in order to explain the overlap degree Vα of dots in the oblique direction. However, in other paragraphs other than the present paragraphs, a plurality of dots arrayed in the sub-scanning direction is called a "row of dots".

Figure 11:
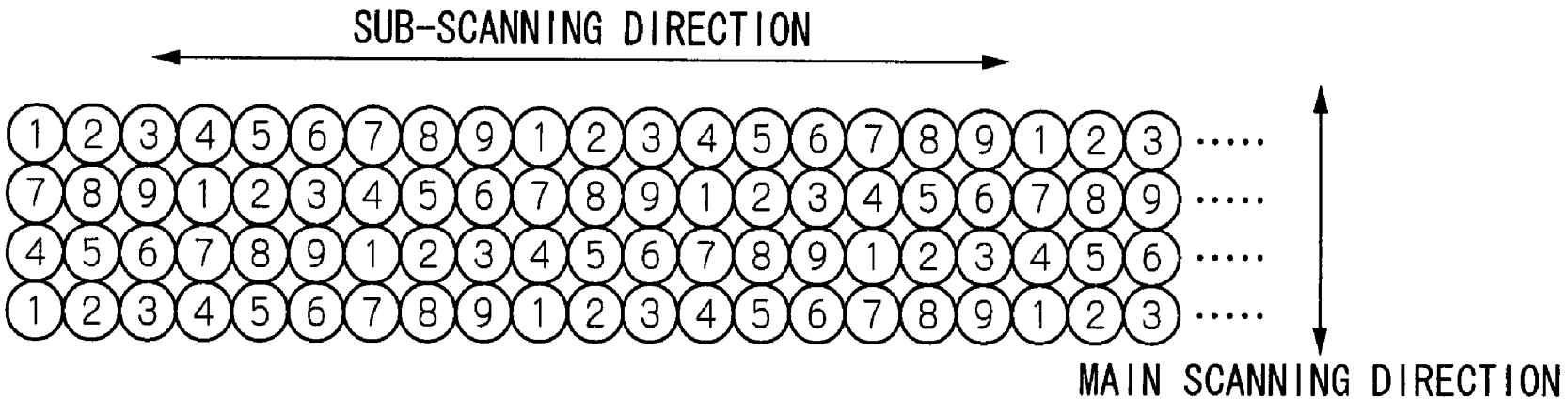
FIG. 11 is an illustrative diagram showing a pattern of deposited order in the state of overlapping shown in FIG. 10.

The basic unit M in the grouping process is sought in a follow equation: M=Vα×Vm=9. A part of the deposition order pattern when the grouping is performed with the basic unit M=9 is shown in FIG. 11.

According to the aforementioned precondition, since the total number K of dots in the sub-scanning direction on recording medium (A4) is sought in an equation: K=Lp/Pt=28301 dots, then the number N of groups can be sought in a following equation:

$$N = K/M = \frac{28301 \text{ dots}}{9} = 3145.$$

In this case, when the fixing time $T_{fix}$ of each dot is sought in an equation: $T_{fix}$=30 ms, and a time $T_{pass}$ when the liquid droplets ejection heads 50 passes the portion in which the recording medium does not exist is sought in an equation: $T_{pass}$=0, then the nozzle ejection cycle $T_{jet}$ can be expressed in a following inequality:

$$T_{jet} \geq T_{fix}/N = \frac{0.030}{3415} = 8.7 \text{ μsec}.$$

However, since the nozzle ejection cycle $T_{jet}$ cannot be practically set shorter than the minimum ejection cycle, then the nozzle ejection cycle $T_{jet}$ is also set to 40 μsec which is the minimum ejection cycle when the minimum ejection cycle is 40 μsec. Therefore, the number of rotations in the rotating drum 33 is sought in an equation:

$$\frac{1}{T_{jet} \times N} \times 60 = 439 \text{ rpm}.$$

On the other hand, when the fixing time $T_{fix}$ of each dot is sought in an equation: $T_{fix}$=200 ms, and a time $T_{pass}$ when the liquid droplets ejection heads 50 passes the portion in which the recording medium does not exist is sought in an equation: $T_{pass}$=0, then the nozzle ejection cycle $T_{jet}$ can be expressed in a following inequality:

$$T_{jet} \geq T_{fix}/N = \frac{0.200}{3415} = 58.5 \text{ μsec}.$$

Therefore, the number of rotations in the rotating drum 33 can be sought in an equation:

$$\frac{1}{T_{jet} \times N} \times 60 = 300 \text{ rpm}.$$

Figure 12:
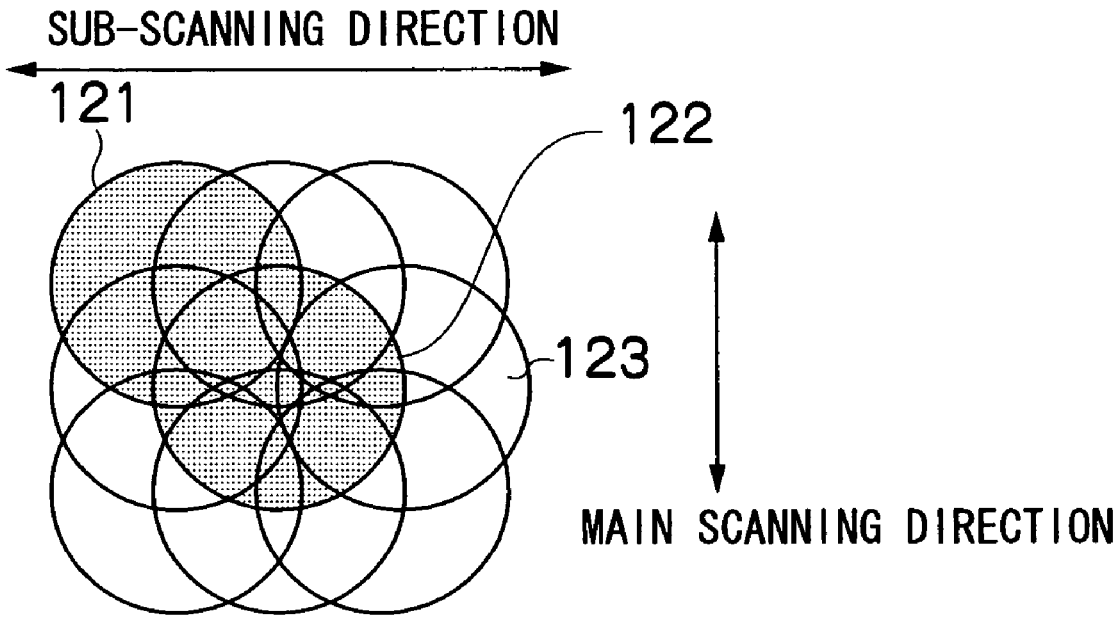
FIG. 12 is an illustrative diagram showing a second example in a state of overlapping of dots.

FIG. 12 shows a second example in a state of overlapping dots.

In FIG. 12, the overlap degree Vs of dots in the sub-scanning direction is "3", and the overlap degree Vm of dots in the main scanning direction is "3".

When the position in which a target dot 121 is present is in a first sub-scanning line and a first main scanning row, the target dot 121 overlaps with a dot 122 which is in a second sub-scanning line in an adjacent main scanning row (second main scanning row), but does not overlap with a dot 123 which is in a third sub-scanning line in the aforementioned main scanning row (second main scanning row). In other words, the overlap degree Vα of dots in the oblique direction is "2". It should be noted in the present paragraph that "line" and "row" are defined for convenience in order to explain the overlap degree Vα of dots in the oblique direction. However, in other paragraphs other than the present paragraphs, a plurality of dots arrayed in the sub-scanning direction is called a "row of dots".

Figure 13:
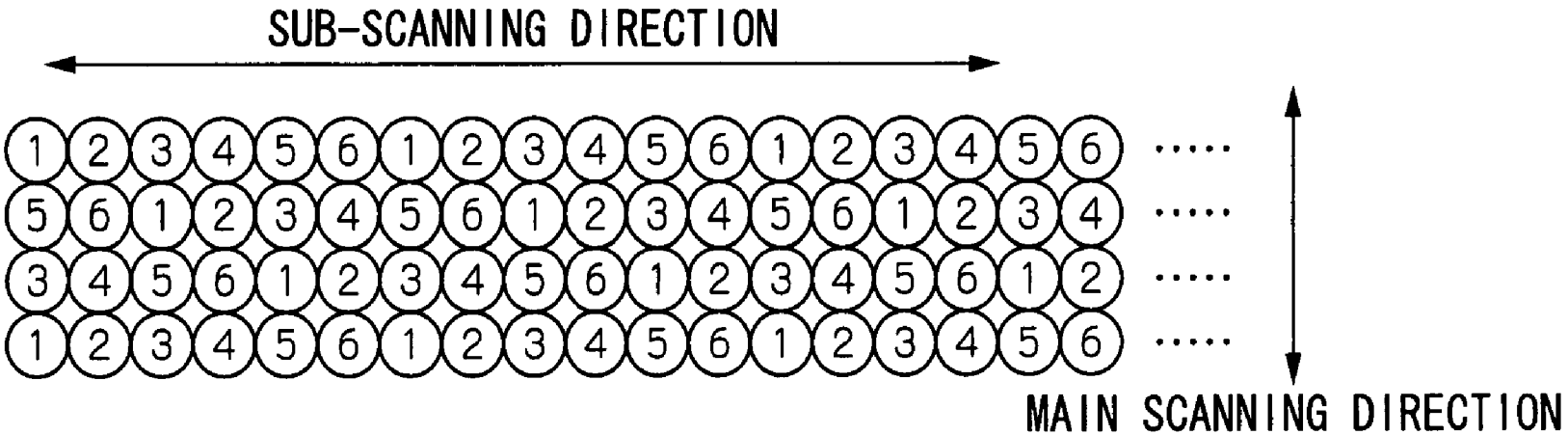
FIG. 13 is an illustrative diagram showing a pattern of deposition order in the state of overlapping shown in FIG. 12.

The basic unit M in the grouping process is sought in an equation: M=Vα×Vm=6. A part of the deposition order mode when grouping is performed with the basic unit M=6 is shown in FIG. 13.

According to the aforementioned preconditions, since the total number K of dots in the sub-scanning direction on recording medium (A4) is sought in an equation: K=Lp/Pt=28301 dots, the number N of groups can be sought in a following equation:

$$N = K/M = \frac{28301 \text{ dots}}{6} = 4717.$$

In this case, when the fixing time $T_{fix}$ of each dot is sought in an equation: $T_{fix}$=30 ms, and a time $T_{pass}$ when the liquid droplets ejection heads 50 passes the portion in which the recording medium does not exist is sought in an equation: $T_{pass}$=0 then the nozzle ejection cycle $T_{jet}$ can be expressed in a following inequality:

$$T_{jet} \geq T_{fix}/N = \frac{0.030}{4717} = 6.3 \text{ μsec}.$$

However, since the nozzle ejection cycle $T_{jet}$ cannot be practically set shorter than the minimum ejection cycle, the nozzle ejection cycle $T_{jet}$ is also set to 40 μsec which is the minimum ejection cycle when the minimum ejection cycle is 40 μsec. Therefore, the number of rotations of the rotating drum 33 can be sought in an equation:

$$\frac{1}{T_{jet} \times N} \times 60 = 318 \text{ rpm}.$$

On the other hand, when the fixing time $T_{fix}$ of each dot is sought in an equation: $T_{fix}$=200 ms, and a time $T_{pass}$ when the liquid droplets ejection heads 50 passes the portion in which the recording medium does not exist is sought in an equation: $T_{pass}$=0, then the nozzle ejection cycle $T_{jet}$ can be expressed in a following inequality:

$$T_{jet} \geq T_{fix}/N = \frac{0.200}{4717} = 42.3 \text{ μsec}.$$

Therefore, the number of rotations of the rotating drum 33 can be sought in an equation:

$$\frac{1}{T_{jet} \times N} \times 60 = 301 \text{ rpm}.$$

Figure 14:
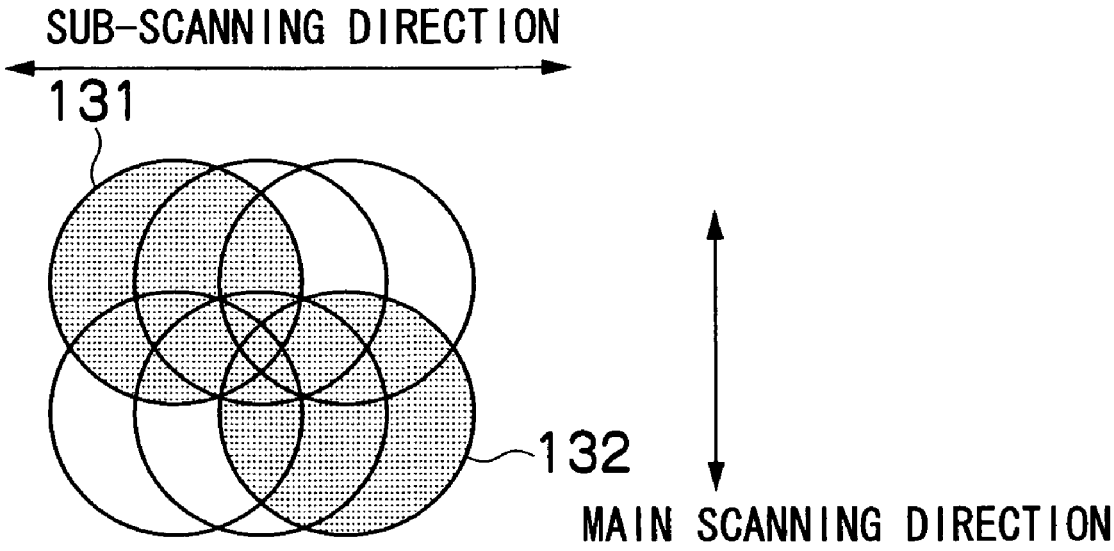
FIG. 14 is an illustrative diagram showing a third example in the state of overlapping dots.

FIG. 14 shows a third example in a state of overlapping dots.

In FIG. 14, the overlap degree Vs of dot overlap in the sub-scanning direction is "3", and the overlap degree Vm of dots in the main scanning direction is "2".

When the position in which a target dot 131 is present is in a first sub-scanning line and a first main scanning row, the target dot 131 overlaps with a dot 132 which is in a third sub-scanning line in an adjacent main scanning row (second main scanning row), but does not overlap with a dot (not shown) which is in a fourth sub-scanning line in the aforementioned main scanning row (second main scanning row). In other words, the overlap degree Vα of dots in the oblique direction is "3". It should be noted in the present paragraph that "line" and "row" are defined for convenience in order to explain the overlap degree Vα of dot overlap in the oblique direction. However, in other paragraphs other than the present paragraphs, a plurality of dots arrayed in the sub-scanning direction is called a "row of dots".

Figure 15:
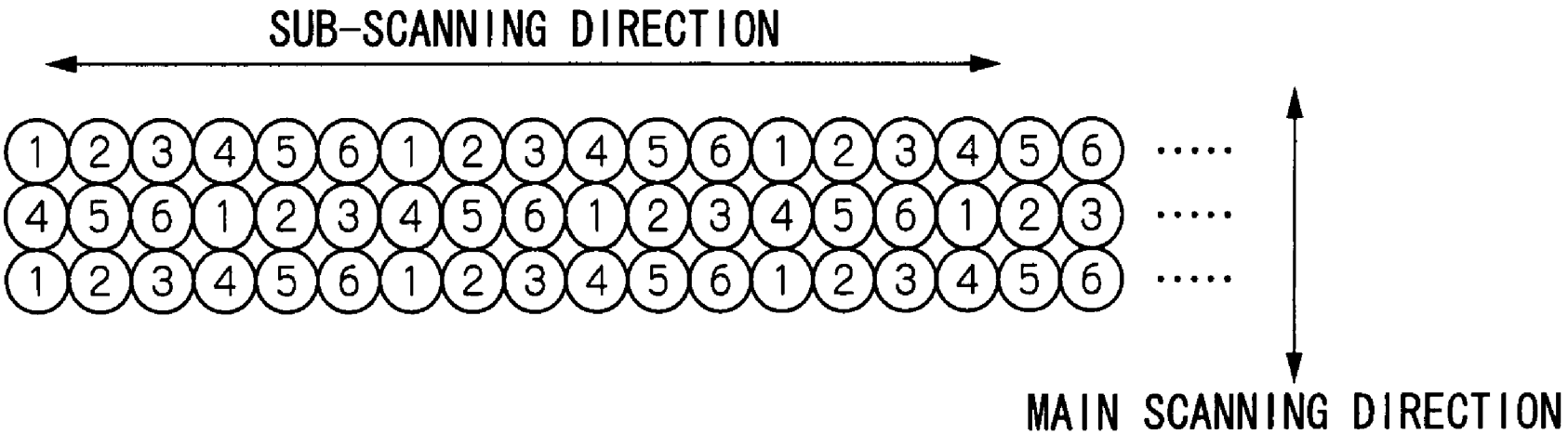
FIG. 15 is an illustrative diagram showing a pattern of deposition order in the state of overlapping shown in FIG. 14.

The basic unit M in the grouping process is sought in an equation: M=Vα×Vm=6. A part of the deposition order pattern when grouping is performed with the basic unit M=6 is shown in FIG. 15.

According to the aforementioned precondition, since the total number K of dots in the sub-scanning direction on recording medium (A4) is sought in an equation: K=Lp/Pt=28301 dots, then the number N of groups can be sought in an equation:

$$N = K/M = \frac{28301 \text{ dots}}{6} = 4717.$$

In this case, when the fixing time $T_{fix}$ of each dot is sought in an equation: $T_{fix}$=30 ms, and a time $T_{pass}$ when the liquid droplets ejection heads 50 passes the portion in which the recording medium does not exist is sought in an equation: $T_{pass}$=0, then the nozzle ejection cycle $T_{jet}$ can be expressed in a following inequality:

$$T_{jet} \geq T_{fix}/N = \frac{0.030}{4717} = 6.3 \text{ μsec}.$$

However, since the nozzle ejection cycle $T_{jet}$ cannot be practically set shorter than the minimum ejection cycle, the nozzle ejection cycle $T_{jet}$ is also set to 40 μsec which is the minimum ejection cycle when the minimum ejection cycle is 40 μsec. Therefore, the number of rotations in the rotating drum 33 can be sought in an equation:

$$\frac{1}{T_{jet} \times N} \times 60 = 318 \text{ rpm}.$$

On the other hand, when the fixing time $T_{fix}$ of each dot is sought in an equation: $T_{fix}$=200 ms, and a time $T_{pass}$ when the liquid droplets ejection heads 50 passes the portion in which the recording medium does not exist is sought in an equation: $T_{pass}$=0, then the nozzle ejection cycle $T_{jet}$ can be expressed in a following inequality:

$$T_{jet} \geq T_{fix}/N = \frac{0.200}{4717} = 42.3 \text{ μsec}.$$

Therefore, the number of rotations of the rotating drum 33 can be sought in an equation:

$$\frac{1}{T_{jet} \times N} \times 60 = 301 \text{ rpm}.$$

Figure 16:
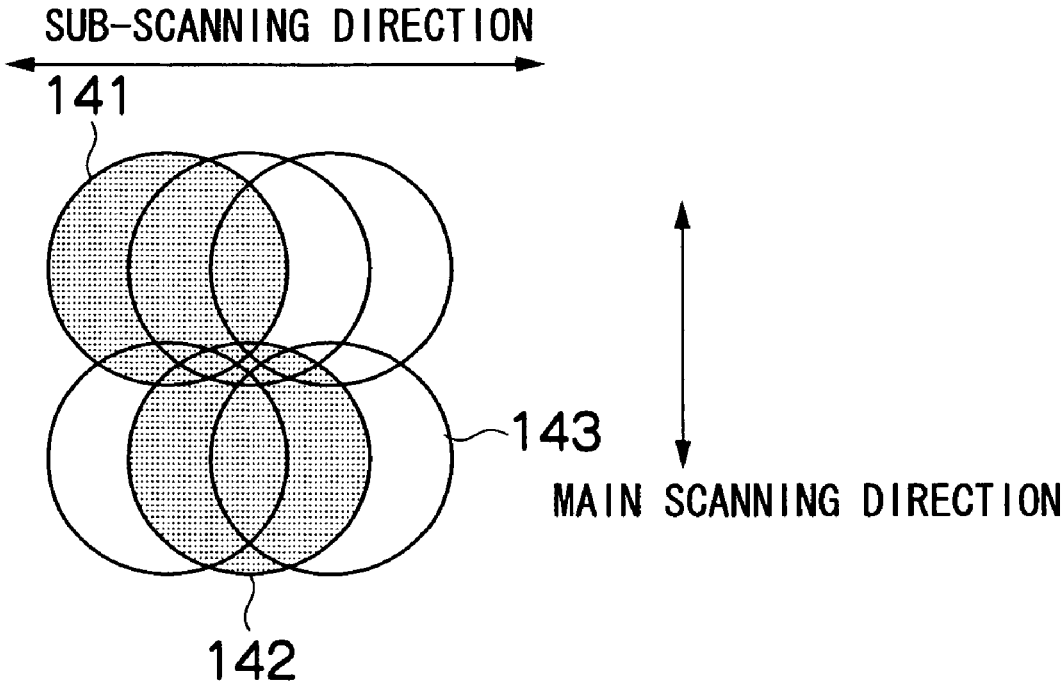
FIG. 16 is an illustrative diagram showing a fourth example in the state of overlapping dots.

FIG. 16 shows a fourth example in a state of overlapping dots.

In FIG. 16, the overlap degree Vs of dots in the sub-scanning direction is "3", and the overlap degree Vm of dots in the main scanning direction is "2".

When the position in which a target dot 141 is present is in a first sub-scanning line and a first main scanning row, the target dot 141 overlaps with a dot 142 which is in a second sub-scanning line in an adjacent main scanning row (second main scanning row), but does not overlap with a dot 143 which is in a third sub-scanning line in the aforementioned main scanning row (second main scanning row). In other words, the overlap degree Vα of dots in the oblique direction is "2". It should be noted in the present paragraph that "line" and "row" are defined for convenience in order to explain the overlap degree Vα of dots in the oblique direction. However, in other paragraphs other than the present paragraphs, a plurality of dots arrayed in the sub-scanning direction is called a "row of dots".

Figure 17:
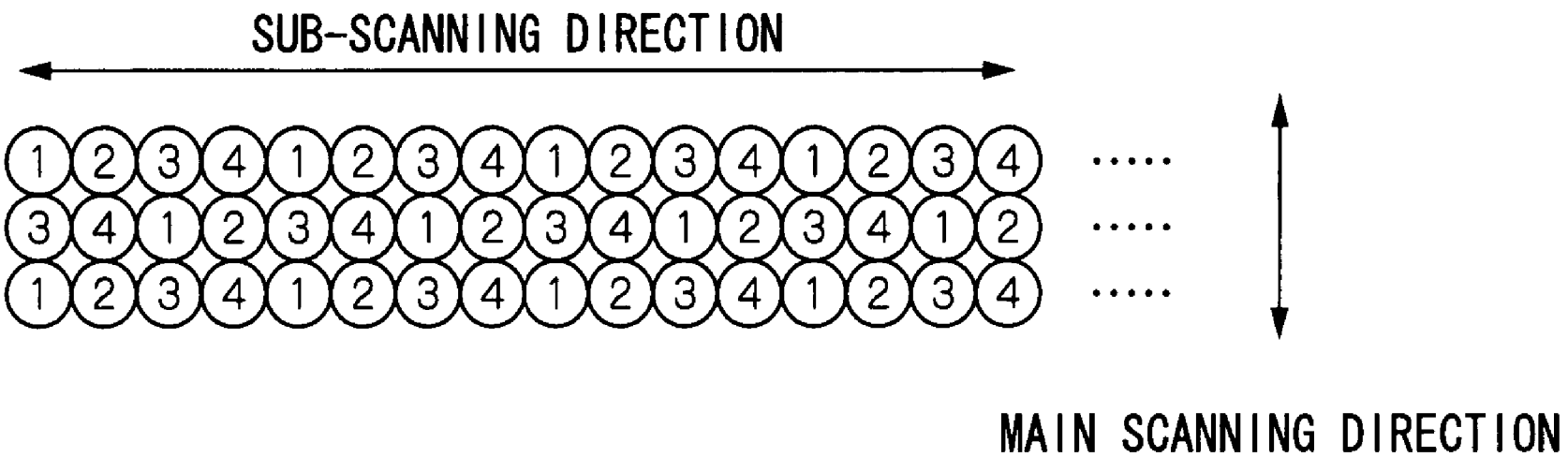
FIG. 17 is an illustrative diagram showing a pattern of the deposition order in the state of overlapping shown in FIG. 16.

The basic unit M in the grouping process is sought in an equation: M=Vα×Vm=4. A part of the deposition order pattern when grouping is performed with the basic unit M=4 is shown in FIG. 17.

According to the aforementioned precondition, since the total number K of dots in the sub-scanning direction on recording medium (A4) is sought in an equation: K=Lp/Pt=28301 dots, then the number N of groups can be sought in a following equation:

$$N = K/M = \frac{28301 \text{ dots}}{4} = 7076.$$

In this case, when the fixing time $T_{fix}$ of each dot is sought in an equation: $T_{fix}$=30 ms, and a time $T_{pass}$ when the liquid droplets ejection heads 50 passes the portion in which the recording medium does not exist is sought in an equation: $T_{pass}$=0, then the nozzle ejection cycle $T_{jet}$ can be expressed in a following inequality:

$$T_{jet} \geq T_{fix}/N = \frac{0.030}{7076} = 4.2 \ \mu\text{sec}.$$

However, since the nozzle ejection cycle $T_{jet}$ cannot be practically set shorter than the minimum ejection cycle, the nozzle ejection cycle $T_{jet}$ is also set to 40 μsec which is the minimum ejection cycle when the minimum ejection cycle is 40 μsec. The number of rotations in the rotating drum 33 can be sought in an equation:

$$\frac{1}{T_{jet} \times N} \times 60 = 318 \text{ rpm}.$$

On the other hand, when the fixing time of each dot is sought in an equation: $T_{fix}$=200 ms, and a time $T_{pass}$ when the liquid droplets ejection heads 50 passes the portion in which the recording medium does not exist is sought in an equation: $T_{pass}$=0, then the nozzle ejection cycle $T_{jet}$ can be expressed in a following inequality:

$$T_{jet} \geq T_{fix}/N = \frac{0.200}{7076} = 28.2 \ \mu\text{sec}.$$

However, since the nozzle ejection cycle $T_{jet}$ cannot be practically set shorter than the minimum ejection cycle, the nozzle ejection cycle $T_{jet}$ is also set to 40 μsec which is the minimum ejection cycle when the minimum ejection cycle is 40 μsec. Therefore, the number of rotations of the rotating drum 33 can be sought in an equation:

$$\frac{1}{T_{jet} \times N} \times 60 = 318 \text{ rpm}.$$

Figure 18:
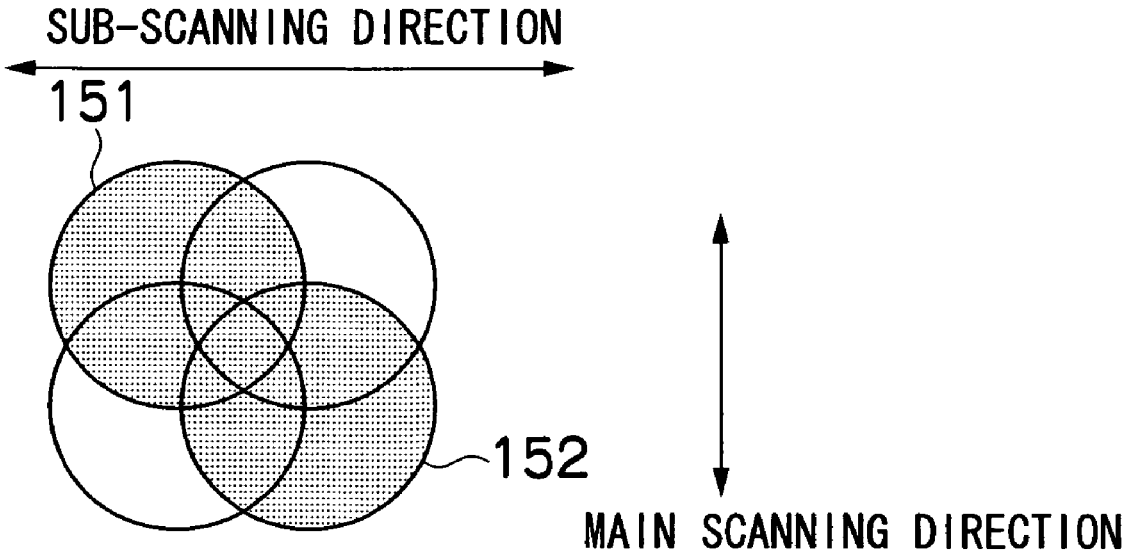
FIG. 18 is an illustrative diagram showing a fifth example in the state of overlapping dots.

FIG. 18 shows a fifth example in a state of overlapping dots.

In FIG. 18, the overlap degree Vs of dots in the sub-scanning direction is "2", and the overlap degree Vm of dots in the main scanning direction is "2".

When the position in which a target dot 151 is present is in a first sub-scanning line and a first main scanning row, the target dot 151 overlaps with a dot 152 which is in a second sub-scanning line in an adjacent main scanning row (second main scanning row), but does not overlap with a dot (not shown) which is in a third sub-scanning line in the aforementioned main scanning row (second main scanning row). In other words, the overlap degree Vα of dots in the oblique direction is "2". It should be noted in the present paragraph that "line" and "row" are defined for convenience in order to explain the overlap degree Vα of dots in the oblique direction. However, in other paragraphs other than the present paragraphs, a plurality of dots arrayed in the sub-scanning direction is called a "row of dots".

Figure 19:
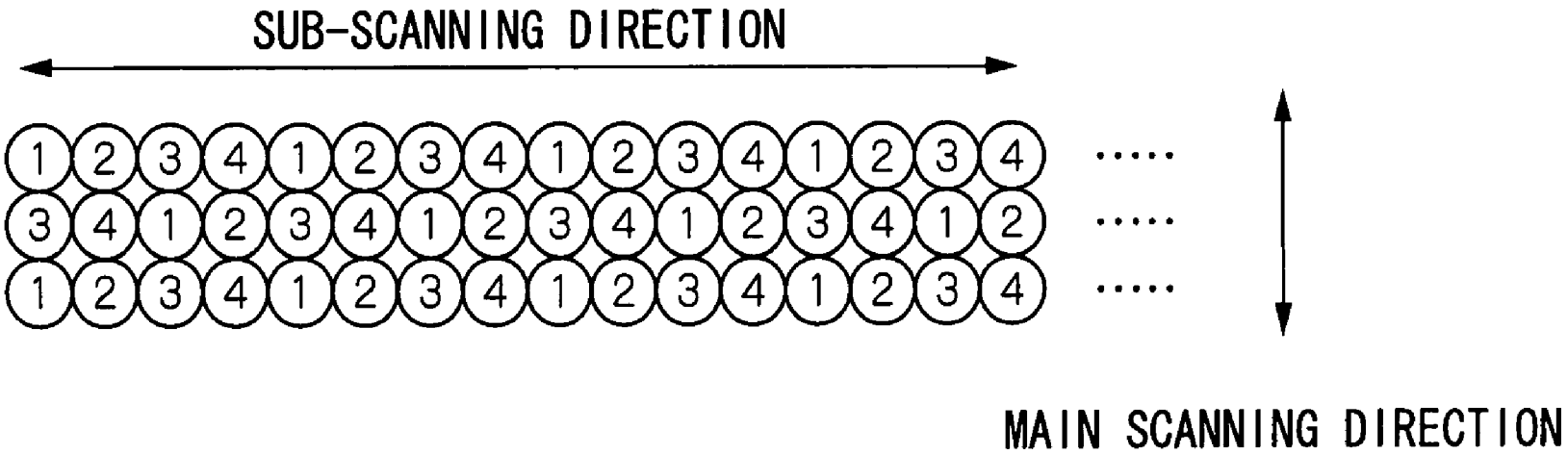
FIG. 19 is an illustrative diagram showing a pattern of deposition order in the state of overlapping shown in FIG. 18.

The basic unit M in the grouping process is sought in an equation: M=Vα×Vm=4. A part of the deposition order pattern when grouping is performed with the basic unit M=4 is shown in FIG. 19.

According to the aforementioned preconditions, since the total number K of dots in the sub-scanning direction on recording medium (A4) is sought in an equation: K=Lp/Pt=28301 dots, then the number of groups can be sought in a following equation:

$$N = K/M = \frac{28301 \text{ dots}}{4} = 7076.$$

In this case, when the fixing time $T_{fix}$ of each dot is sought in an equation: $T_{fix}$=30 ms, and a time $T_{pass}$ when the liquid droplets ejection heads 50 passes the portion in which the recording medium does not exist is sought in an equation: $T_{pass}$=0, then the nozzle ejection cycle $T_{jet}$ can be expressed in a following inequality:

$$T_{jet} \geq T_{fix}/N = \frac{0.030}{7076} = 4.2 \ \mu\text{sec}.$$

However, since the nozzle ejection cycle $T_{jet}$ cannot be practically set shorter than the minimum ejection cycle, the nozzle ejection cycle $T_{jet}$ is also set to 40 μsec which is the minimum ejection cycle when the minimum ejection cycle is 40 μsec. Therefore, the number of rotations in the rotating drum 33 can be sought in an equation:

$$\frac{1}{T_{jet} \times N} \times 60 = 318 \text{ rpm.}$$

On the other hand, when the fixing time $T_{fix}$ of each dot is sought in an equation: $T_{fix}$=200 ms, and a time $T_{pass}$ when the liquid droplets ejection heads 50 passes the portion in which the recording medium does not exist is sought in an equation: $T_{pass}$=0, then the nozzle ejection cycle $T_{jet}$ can be expressed in a following inequality:

$$T_{jet} \geq T_{fix} / N = \frac{0.200}{7076} = 28.2 \text{ μsec.}$$

However, since the nozzle ejection cycle $T_{jet}$ cannot be practically set shorter than the minimum ejection cycle, the nozzle ejection cycle $T_{jet}$ is also set to 40 μsec which is the minimum ejection cycle when the minimum ejection cycle is 40 μsec. Therefore, the number of rotations in the rotating drum 33 can be sought in an equation:

$$\frac{1}{T_{jet} \times N} \times 60 = 318 \text{ rpm.}$$

Figure 20:
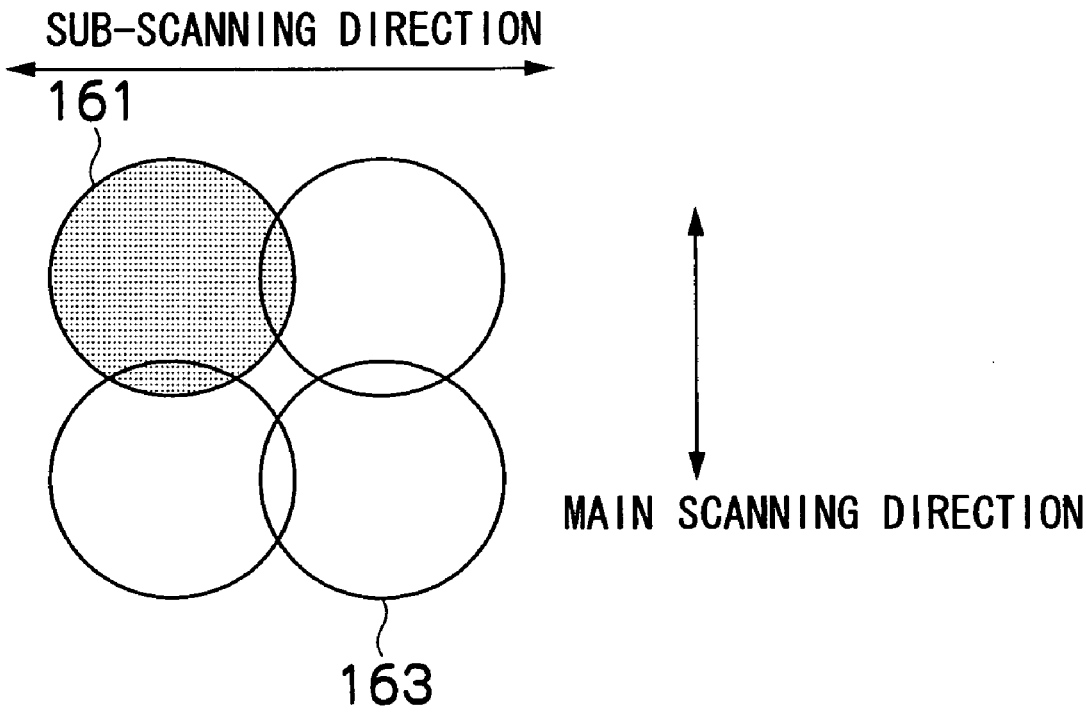
FIG. 20 is an illustrative diagram showing a sixth example of the state of overlapping dots.

FIG. 20 shows a sixth example in a state of overlapping dots.

In FIG. 20, the overlap degree of dots in the sub-scanning direction Vs is "2", and the overlap degree of dots in the main scanning direction Vm is "2".

When the position in which a target dot 161 is present is in a first sub-scanning line and a first main scanning row, the target dot 161 does not overlap with a dot 163 which is in a second sub-scanning line in an adjacent main scanning row (second main scanning row). In other words, the overlap degree of dots in the oblique direction Vα is "1". It should be noted in the present paragraph that "line" and "row" are defined for convenience in order to explain the overlap degree of dots in the oblique direction Vα. However, in other paragraphs other than the present paragraphs, a plurality of dots arrayed in the sub-scanning direction is called a "row of dots".

Figure 21:
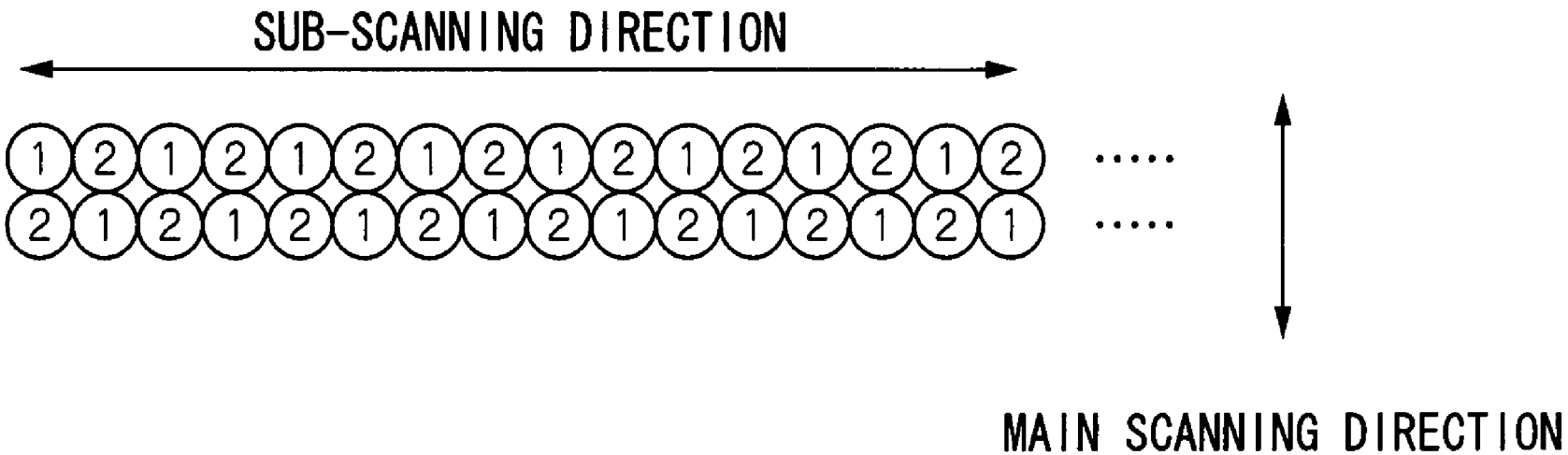
FIG. 21 is an illustrative diagram showing a pattern of deposition order in the state of overlapping shown in FIG. 20.

The basic unit M in the grouping process is sought in an equation: M=Vα×Vm=2. A part of the deposition order pattern when grouping is performed with the basic unit M=2 is shown in FIG. 21.

According to the aforementioned precondition, since the total number K of dots in the sub-scanning direction on recording medium (A4) is sought in an equation: K=Lp/Pt=28301 dots, then the number N of groups can be sought in a following equation:

$$N = K / M = \frac{28301 \text{ dots}}{2} = 14151.$$

In this case, when the fixing time $T_{fix}$ of each dot is sought in an equation: $T_{fix}$=30 ms, and a time $T_{pass}$ when the liquid droplets ejection heads 50 passes the portion in which the recording medium does not exist is sought in an equation: $T_{pass}$=0, then the nozzle ejection cycle $T_{jet}$ can be expressed in a following inequality:

$$T_{jet} \geq T_{fix} / N = \frac{0.030}{14151} = 2.1 \text{ μsec.}$$

However, since the nozzle ejection cycle $T_{jet}$ cannot be practically set shorter than the minimum ejection cycle, the nozzle ejection cycle $T_{jet}$ is also set to 40 μsec which is the minimum ejection cycle when the minimum ejection cycle is 40 μsec. The number of rotations in the rotating drum 33 can be sought in an equation:

$$\frac{1}{T_{jet} \times N} \times 60 = 106 \text{ rpm.}$$

On the other hand, when the fixing time $T_{fix}$ of each dot is sought in an equation: $T_{fix}$=200 ms, and a time $T_{pass}$ when the liquid droplets ejection heads 50 passes the portion in which the recording medium does not exist is sought in an equation: $T_{pass}$=0, then the nozzle ejection cycle $T_{jet}$ can be expressed in a following inequality:

$$T_{jet} \geq T_{fix} / N = \frac{0.200}{14151} = 14.1 \text{ μsec.}$$

However, since the nozzle ejection cycle $T_{jet}$ cannot be practically set shorter than the minimum ejection cycle, the nozzle ejection cycle $T_{jet}$ is also set to 40 μsec which is the minimum ejection cycle when the minimum ejection cycle is 40 μsec. The number of rotations in the rotating drum 33 can be sought in an equation:

$$\frac{1}{T_{jet} \times N} \times 60 = 106 \text{ rpm.}$$

Next, an example in which grouping is performed without using the overlap degree of dots in the oblique direction Vα will be described.

Figure 22:
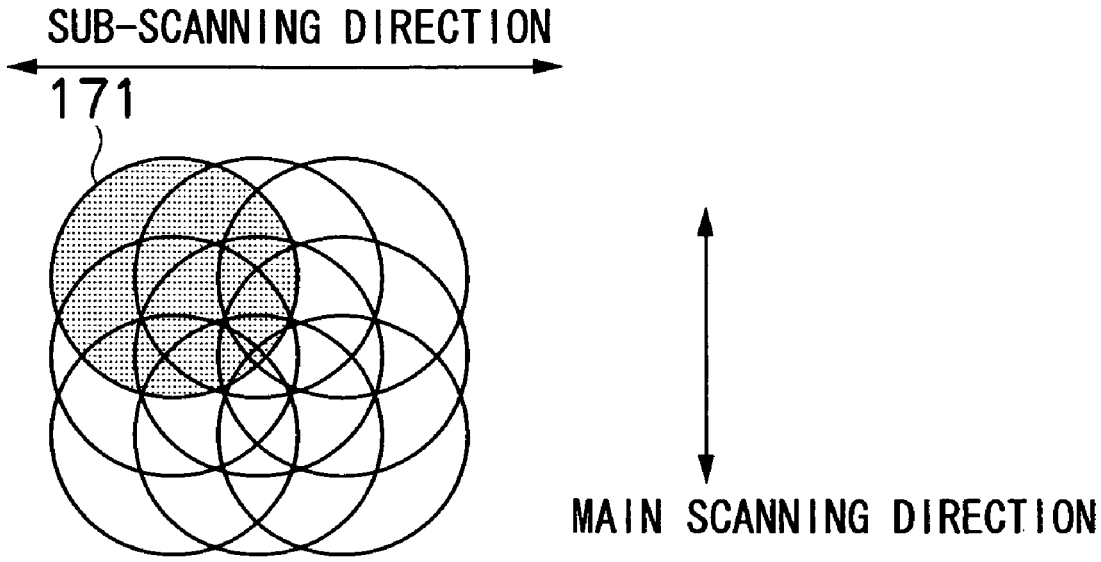
FIG. 22 is an illustrative diagram showing a seventh example in the state of overlapping dots.

FIG. 22 show a state of overlapping dots, in the case in which the overlap degree Vs of dots in the sub-scanning direction is "3", and the overlap degree Vm of dots in the main scanning direction is "3".

In this case, the overlap degree Vs of dots in the sub-scanning direction and the overlap degree Vs of dots in the main scanning direction are noted to perform grouping, but the overlap degree Vα of dots in the oblique direction is not noted.

Figure 23:
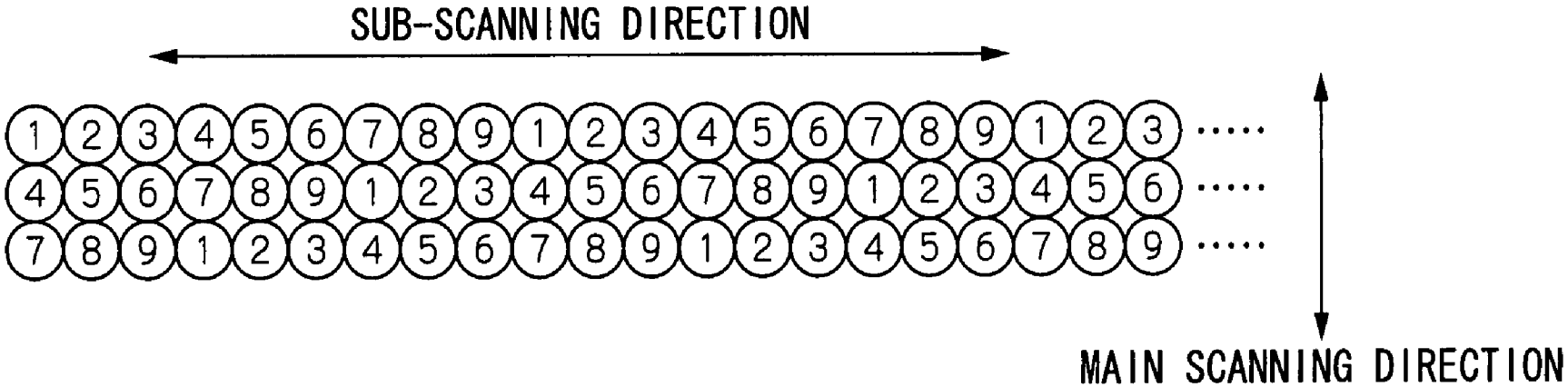
FIG. 23 is an illustrative diagram showing a pattern of deposition order in the state of the overlap shown in FIG. 22.

FIG. 23 shows a part of pattern of grouped deposition order.

More specifically, when a solid image is formed on the recording medium, a deposition order is set by grouping a dot array with a block, in which the number of dots in the sub-scanning direction is Vs and the number of dots in the main scanning direction is Vm, as the basic unit, so that dots are arrayed two-dimensionally with (Vs−1) dots interval in the sub-scanning direction and with (Vm−1) dots interval in the main scanning direction.

For explanation of this grouping process from a different perspective, dot deposition is performed in the sub-scanning direction with (M−1) dots interval when the basic unit M as an integer satisfies a condition: M≧Vs, and dot deposition is performed sequentially from the (i×Vm+1)-th main scanning line to the ((i+1)×Vm)-th main scanning line in the main scanning direction when i as an integer is more than 0, thereby a deposition order is set.

According to the aforementioned precondition, since the total number K of dots in the sub-scanning direction on recording medium (A4) is sought in an equation: K=Lp/Pt=28301 dots, then the number N of groups can be sought in a following equation:

$$N = K/M = \frac{28301 \text{ dots}}{3} = 9434.$$

In this case, when the fixing time $T_{fix}$ of each dot is sought in an equation: $T_{fix}$=30 ms, and a time $T_{pass}$ when the liquid droplets ejection heads 50 passes the portion in which the recording medium does not exist is sought in an equation: $T_{pass}$=0, then the nozzle ejection cycle $T_{jet}$ can be expressed in a following inequality:

$$T_{jet} \geq T_{fix}/N = \frac{0.030}{9434} = 3.1 \ \mu\text{sec}.$$

However, since the nozzle ejection cycle $T_{jet}$ cannot be set practically shorter than the minimum ejection cycle, the nozzle ejection cycle $T_{jet}$ is also set to 40 μsec which is the minimum ejection cycle when the minimum ejection cycle is 40 μsec. The number of rotations in the rotating drum 33 can be sought in an equation:

$$\frac{1}{T_{jet} \times N} \times 60 = 159 \ rpm.$$

The first setting mode for setting the deposition order by using the overlap degree Vα of dots in the oblique direction as described with reference in FIGS. 10 to 21, is compared with the second setting mode for setting the deposition order without using the overlap degree Vα of dots in the oblique direction as described with reference in FIGS. 22 and 23.

Compared to the second setting pattern, the first setting pattern has following advantages 1 and 2.

Advantage 1

Since the deposition order is set according to the overlap degree Vα of dots in the oblique direction, the number of scanning in the sub-scanning direction is shorter in the first setting mode than the second setting mode. Therefore, depending on the state of overlapping the dots, an image can be formed at higher speed. For example, in the case of overlapping the dots shown in FIG. 12, the printing time in the first setting mode can be reduced to two-thirds of the printing time in the second setting mode.

Advantage 2

In the first setting mode, since the entire main scanning lines are deposited during one rotation in the rotating drum 33, almost no paused nozzle exists. On the other hand, in the second setting mode, only 1/Vm of the nozzles (e.g., one third of the nozzles) ejects during one rotation of the rotating drum 33, thus $$\left(1 - \frac{1}{Vm}\right)$$

of the nozzles (e.g., two thirds of the nozzles) are paused. Therefore, clogging of the nozzles occur easily with a highly-volatile ink due to the thickness of ink.

Even if the same ink or same recording medium is used, a plurality of numerical values for the overlap degrees Vs, Vm, and Vα may be intermixed inside an image, depending on the image to be outputted. In other words, if three types of large, medium, and small dot diameters are intermixed, the overlap degrees Vs, Vm, and Vα respectively have a plurality of numerical values. In this case, the overlap degree obtained when forming an image with the largest dot diameter is taken as a representative value for setting the deposition order by means of the deposition order setting device 92, and therefore, it is possible to prevent interference of deposited dots while reducing the computation load, thereby obtaining a high-quality image at high speed.

Hereinafter, image formation time according to the present embodiment will be considered.

In the case in which the present invention is not applied, when the fixing time $T_{fix}$ of each dot is sought in an equation: $T_{fix}$=30 ms, and the total number K of dots in the sub-scanning direction is sought in an equation: K=28301 dots, then the total time T1 in image formation with a single ink can be sought in a following equation:

$$T1 = 30 \text{ msec} \times 28301 = 849 \text{ sec}.$$

Furthermore, the total time T4 in image formation with CMYK four colors of inks can be sought in a following equation:

$$T4 = 849 \text{ sec} \times 4 = 3396 \text{ sec}.$$

On the other hand, in the case in which the present invention is applied, all dots can be deposited in an ejection cycle $T_{jet}$ is approximately $T_{jet}$=40 μsec, then the total time T1 in image formation with a single color can be sought in a following equation:

$$T1 = 40 \ \mu\text{sec} \times 28301 = 1.13 \text{ sec}.$$

Accordingly, it is possible to form an image at high speed while preventing interference of deposited dots.

In addition, the total time T4 in image formation with CMYK four colors of inks can be sought in a following equation:

$$T4 = 1.13 \text{ sec} \times 4 = 4.52 \text{ sec}.$$

It should be noted that the present invention can be applied to not only a mode in which the recording medium is wrapped around the rotating drum and droplets are ejected directly onto the recording medium to form dots on the recording medium, but also a mode in which dots are formed on the rotating drum functioning as the intermediate transfer medium and thereafter are transferred to the recording medium.

Moreover, it should be understood that the present invention is not limited to the examples described in the embodiments, but, on the contrary, is to cover various modifications and improvements falling within the scope of the invention.

It should be understood, however, that there is no intention to limit the invention to the specific forms disclosed, but on the contrary, the invention is to cover all modifications, alternate constructions and equivalents falling within the spirit and scope of the invention as expressed in the appended claims.

What is claimed is:

1. An image forming apparatus, comprising:

a liquid droplets ejection head which has a plurality of nozzles in a main scanning direction, the liquid droplets ejection head ejecting droplets of liquid toward a predetermined recording medium from one of the nozzles selected from the plurality of nozzles according to a predetermined image signal so that an image comprising a plurality of dots corresponding to the image signal is formed on the recording medium;

a relative movement device which moves the liquid droplets ejection head and the recording medium relative to each other in a sub-scanning direction by causing the liquid droplets ejection head to scan the recording medium several times in order to eject the droplets of the liquid so that the adjacent dots in the sub-scanning direction are formed by overlapping with each other, wherein M is an integer more than an overlap degree of the adjacent dots in the sub-scanning direction, and then N is a natural number;

a fixing time specifying device which specifies a fixing time during which each of the dots is fixed on the recording medium;

a deposition order setting device which sets a deposition order of the dots in the sub-scanning direction according to the overlap degree of the adjacent dots in at least the sub-scanning direction wherein the deposition order setting device divides a row of the dots in the sub-scanning direction into N groups with the M as a basic unit, and the deposition order setting device sets the deposition order of the dots in the sub-scanning direction so that the dots are deposited with (M−1) dots interval; and a deposition time difference setting device which sets a difference between deposition times of the adjacent dots in the sub-scanning direction so that the difference between the deposition times of the adjacent dots in the sub-scanning direction is more than the fixing time of each of the dots.

2. The image forming apparatus as defined in claim 1, wherein the deposition order setting device sets the deposition order of the dots in the sub-scanning direction according to the fixing time of each of the dots, an output resolution in the sub-scanning direction, and the overlap degree of the adjacent dots in the sub-scanning direction.

3. The image forming apparatus as defined in claim 1, wherein:

the relative movement device further comprises a rotating body which has a circumferential length; and the circumferential length corresponds to the fixing time of each of the dots, an output resolution in the sub-scanning direction, ejection cycles of the nozzles, and the basic unit M.

4. The image forming apparatus as defined in claim 1, wherein:

the relative movement device further comprises a rotating body which has a circumferential length; and the circumferential length corresponds to the fixing time of each of the dots according to a combination of a most used type of the recording medium and a most used type of the liquid, a maximum value of an output resolution in the sub-scanning direction, a shortest ejection cycle of the nozzles, and an overlap degree of the dots when forming the image at a high quality mode.

5. The image forming apparatus as defined in claim 1, wherein the basic unit M in the groups is equal to the overlap degree of the dots.

6. The image forming apparatus as defined in claim 1, wherein:

when the dots with different dot diameters are deposited, the deposition order setting device sets the deposition order by means of the overlap degree of the dots with the largest dot diameter.

7. The image forming apparatus as defined in claim 1, wherein the relative movement device is constituted by a rotating drum which rotates while wrapping the recording medium around the surface of the rotating drum.

8. The image forming apparatus as defined in claim 1, wherein:

the relative movement device comprises a rotating transfer drum which functions as an intermediate transfer recording medium, and a transfer device which applies pressure to the rotating transfer drum and the recording medium in order to perform transfer.

9. An image forming apparatus, comprising:

a liquid droplets ejection head which has a plurality of nozzles in a main scanning direction, the liquid droplets ejection head ejecting droplets of liquid toward a predetermined recording medium from one of the nozzles selected from the plurality of nozzles according to a predetermined image signal so that an image comprising a plurality of dots corresponding to the image signal is formed on the recording medium;

a relative movement device which moves the liquid droplets ejection head and the recording medium relative to each other in a sub-scanning direction by causing the liquid droplets ejection head to scan the recording medium several times;

a fixing time specifying device which specifies a fixing time during which each of the dots is fixed on the recording medium;

a deposition order setting device which sets a deposition order of the dots in the sub-scanning direction and the main scanning direction according to an overlap degree of the dots in an oblique direction with respect to at least the sub-scanning direction, wherein the overlap degree of the dots in the oblique direction is $V\alpha$, and then the overlap degree of the dots in the main scanning direction is Vm, the deposition order setting device divides a row of the dots in the sub-scanning direction with $V\alpha \times Vm$ as a basic unit so that the droplets are deposited with ($V\alpha \times Vm-1$) dots interval in the sub-scanning direction, and the deposition order setting device sets the deposition order by setting a phase difference of the $V\alpha$ dots between the adjacent dots in the main scanning direction so that the droplets are deposited with (Vm−1) dots interval in the main scanning direction; and a deposition time difference setting device which sets a difference between deposition times of the adjacent dots so that the difference between the deposition times of the adjacent dots overlapping with each other is more than the fixing time of each of the dots.

10. The image forming apparatus as defined in claim 9, wherein:

the deposition order is set according to the fixing time of each of the dots, the overlap degree of the dots in the main scanning direction, and the overlap degree of the dots in the oblique direction.

11. The image forming apparatus as defined in claim 9, wherein the deposition time difference setting device sets an ejection cycle of each of the nozzles according to the deposition order which is set by the deposition order setting device.

12. The image forming apparatus as defined in claim 9, wherein:

when said plurality of dots with different dot diameters are deposited, the deposition order setting device sets the deposition order by means of the overlap degree of the dots with a largest dot diameter.

13. The image forming apparatus as defined in claim 9, wherein the relative movement device is constituted by a rotating drum which rotates while wrapping the recording medium around the surface of the rotating drum.

14. The image forming apparatus as defined in claim 9, wherein:

the relative movement device comprises a rotating transfer drum which functions as an intermediate transfer recording medium, and a transfer device which applies pressure to the rotating transfer drum and the recording medium in order to perform transfer.

15. An image forming apparatus, comprising:

a liquid droplets ejection head which has a plurality of nozzles in a main scanning direction, the liquid droplets ejection head ejecting droplets of liquid toward a predetermined recording medium from one of the nozzles selected from the plurality of nozzles according to a predetermined image signal so that an image comprising a plurality of dots corresponding to the image signal is formed on the recording medium;

a relative movement device which moves the liquid droplets ejection head and the recording medium relative to each other in a sub-scanning direction by causing the liquid droplets ejection head to scan the recording medium several times;

a fixing time specifying device which specifies a fixing time during which each of the dots is fixed on the recording medium;

a deposition order setting device which sets a deposition order so tat the droplets are deposited with (M−1) dots interval in the sub-scanning direction, the deposition order setting device setting the deposition order so that the droplets are deposited sequentially from (i×Vm+1)-th main scanning line to ((i+1)×Vm)-th main scanning line, the M being an integer for satisfying a condition of M≧Vs, the Vs is an overlap degree of the dots in the sub-scanning direction, the Vm being the overlap degree of dots in the main scanning direction, the i being an integer more than 0; and a deposition time difference setting device which sets a difference between deposition times of the adjacent dots so that the difference between the deposition times of the adjacent dots overlapping with each other is more than the fixing time of each of the dots.

16. The image forming apparatus as defined in claim 15, wherein the relative movement device is constituted by a rotating drum which rotates while wrapping the recording medium around the surface of the rotating drum.

17. The image forming apparatus as defined in claim 15, wherein:

the relative movement device comprises a rotating transfer drum which functions as an intermediate transfer recording medium, and a transfer device which applies pressure to the rotating transfer drum and the recording medium in order to perform transfer.

* * * * *